US009637923B2

(12) United States Patent
Radhouane et al.

(10) Patent No.: US 9,637,923 B2
(45) Date of Patent: May 2, 2017

(54) COMPOSITE STRUCTURAL MEMBER, METHOD FOR MANUFACTURING SAME, AND CONNECTING ASSEMBLIES FOR COMPOSITE STRUCTURAL MEMBERS

(71) Applicant: SOCPRA SCIENCES ET GENIE S.E.C., Sherbrooke (CA)

(72) Inventors: Masmoudi Radhouane, Sherbrooke (CA); Abouzied Ahmed, Sherbrooke (CA)

(73) Assignee: SOCPRA SCIENCES ET GENIE S.E.C., Sherbrooke (CA)

( * ) Notice: Subject to any disclaimer, the term of this patent is extended or adjusted under 35 U.S.C. 154(b) by 0 days.

(21) Appl. No.: 15/031,300

(22) PCT Filed: Oct. 30, 2014

(86) PCT No.: PCT/CA2014/051045

§ 371 (c)(1),
(2) Date: Apr. 22, 2016

(87) PCT Pub. No.: WO2015/061906

PCT Pub. Date: May 7, 2015

(65) Prior Publication Data

US 2016/0258160 A1 Sep. 8, 2016

Related U.S. Application Data

(60) Provisional application No. 61/897,429, filed on Oct. 30, 2013.

(51) Int. Cl.

| | |
|---|---|
| ***E04C 3/34*** | (2006.01) |
| ***E04C 3/293*** | (2006.01) |
| ***E04C 5/07*** | (2006.01) |
| ***E04C 3/29*** | (2006.01) |
| ***E04B 1/30*** | (2006.01) |
| ***E04C 3/36*** | (2006.01) |
| ***E04C 5/06*** | (2006.01) |

(Continued)

(52) U.S. Cl.

CPC ..... *E04C 3/34* (2013.01); *E04B 1/30* (2013.01); *E04C 3/29* (2013.01); *E04C 3/293* (2013.01);

(Continued)

(58) Field of Classification Search

CPC . E04C 3/34; E04C 3/36; E04C 5/0613; E04C 5/168; E04H 12/2292

See application file for complete search history.

(56) References Cited

U.S. PATENT DOCUMENTS 4,166,347 A * 9/1979 Pohlman ..... E04C 3/34 52/223.4

6,123,485 A 9/2000 Mirmiran et al.

(Continued)

FOREIGN PATENT DOCUMENTS

| | | | |
|---|---|---|---|
| CN | 101177966 | A | 5/2008 |
| JP | 04330133 | A | 11/1992 |
| TN | SN03010 | A1 | 8/2004 |

OTHER PUBLICATIONS

Quirion, René-Charles, Un pont Champlain made in Sherbrooke, La Tribune, La Presse, Dec. 6, 2011, http://www.lapresse.ca/la-tribune/201112/01/01-4473633-un-pont-champlain-made-in-sherbrooke.php.

(Continued)

*Primary Examiner* — Patrick Maestri

(74) *Attorney, Agent, or Firm* — ROBIC

(57) ABSTRACT

A structural member having a longitudinal axis comprises: an exterior shell member defining an elongated channel with an inner surface; an interior shell member having an outer surface and defining an inner channel, inserted in the elongated channel of the exterior shell member and extending longitudinally therein and defining an inter-shell spacing therebetween; and concrete filling the inter-shell spacing and including at least one reinforcement bar having a longitudinally extending section extending in the inter-shell spacing and being disconnected from the inner surface of the exterior shell member and from the outer surface of the interior shell member.

26 Claims, 20 Drawing Sheets

(51) Int. Cl.

| | |
|---|---|
| ***E04C 5/16*** | (2006.01) |
| ***E04H 12/22*** | (2006.01) |
| *E04B 1/21* | (2006.01) |

(52) U.S. Cl.
CPC ..... *E04C 3/36* (2013.01); *E04C 5/0613* (2013.01); *E04C 5/07* (2013.01); *E04C 5/168* (2013.01); *E04H 12/2292* (2013.01); *E04B 1/215* (2013.01)

(56) References Cited

U.S. PATENT DOCUMENTS

| | | | | |
|---|---|---|---|---|
| 2001/0023568 | A1* | 9/2001 | Edwards | E04C 5/03 52/649.1 |
| 2002/0159843 | A1* | 10/2002 | Hubbell | E02D 5/24 405/231 |
| 2009/0000214 | A1* | 1/2009 | Stanley | E04B 1/30 52/94 |
| 2012/0124937 | A1* | 5/2012 | Teng | E04B 5/43 52/834 |

OTHER PUBLICATIONS

Meunier, Marty-Kanatakhatsus, De nouvelles structures hybrides à haute performance plus durables, Université de Sherbrooke, Jun. 3, 2011, https://www.usherbrooke.ca/medias/nouvelles/recherche/recherche-details/article/15742/.

* cited by examiner

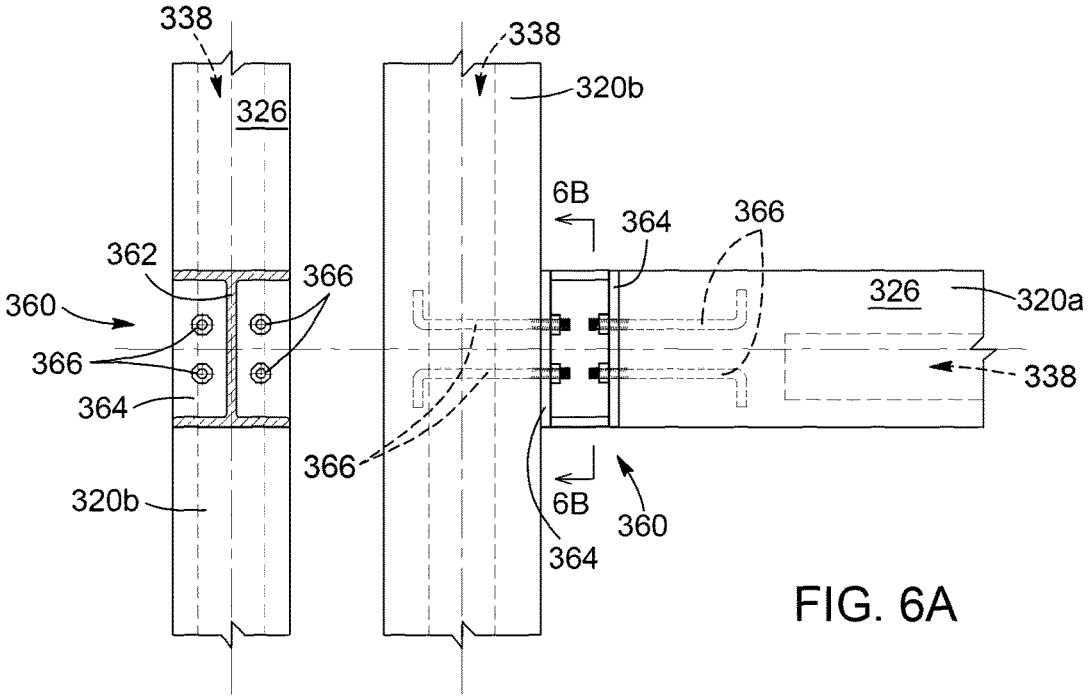
FIG. 6A
FIG. 6B
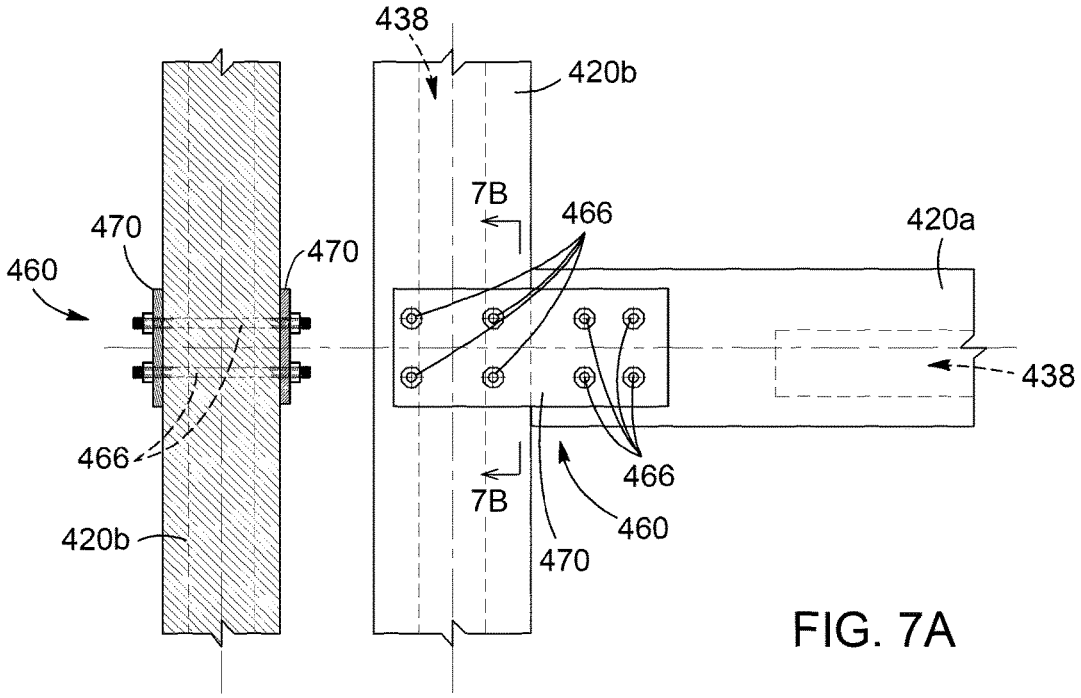
FIG. 7A
FIG. 7B

COMPOSITE STRUCTURAL MEMBER, METHOD FOR MANUFACTURING SAME, AND CONNECTING ASSEMBLIES FOR COMPOSITE STRUCTURAL MEMBERS

CROSS-REFERENCE TO RELATED APPLICATIONS

This application claims priority under 35 USC §119(e) of US provisional patent application No. 61/897,429 filed on Oct. 30, 2013, the specification of which is hereby incorporated by reference. This application is a national phase entry of PCT patent application serial number PCT/CA2014/051045 filed on Oct. 30, 2014, (now pending) designating the United State of America.

TECHNICAL FIELD OF THE INVENTION

The technical field relates to structural members such as beams and columns. More particularly, it relates to composite structural members including an outer shell defining an inner space at least partially filled with concrete. It also relates to a method for producing same. Furthermore, it relates to connecting assemblies for connecting at least two mutually perpendicular composite structural members.

BACKGROUND

Structural members for infrastructure, such as beams and columns, are typically made from steel and/or concrete. However, over the years, both have shown several drawbacks. For instance, corrosion is a problem for steel structural supports especially in corrosive environments. Concrete structural members are also subjected to deterioration of their long-term durability and their structural durability. Permeability of the exposed concrete by water can cause the concrete to deteriorate over time. For example, in northern climate areas that are subjected to the changeable weather conditions due to winter and summer, moisture trapped and frozen in concrete during the winter can expand during summer and cracks the concrete structural members. Furthermore, corrosion is known to occur to the reinforcing steel bars used inside reinforced concrete (RC) structural members.

Over the last years, the use of an external tube, as an outer shell, filled with concrete has been found to isolate and waterproof exposed concrete structural applications, as well as remove the need for formwork and formwork removal. However, these structural members are typically relatively heavy, which may increase transportation and installation costs substantially.

BRIEF SUMMARY OF THE INVENTION

It is therefore an aim of the present invention to address the above mentioned issues.

According to a general aspect, there is provided a structural member having a longitudinal axis. The structural member comprises: an exterior shell member defining an elongated channel with an inner surface; an interior shell member having an outer surface and defining an inner channel, the interior shell member being inserted in the elongated channel of the exterior shell member and extending longitudinally therein; and concrete between the interior shell member and the exterior shell member with at least one reinforcement bar including a longitudinally extending section extending along the longitudinal axis and between the interior shell member and the exterior shell member and being disconnected from the inner surface of the exterior shell member and from the outer surface of the interior shell member.

In an embodiment, each one of the interior shell member and the exterior shell member comprises two opposed ends, the ends of the inner shell member being spaced-apart inwardly along the longitudinal axis from a corresponding end of the exterior shell member. The ends of the interior shell member, spaced-apart inwardly along the longitudinal axis from the corresponding end of the exterior shell member, can be covered with the concrete.

In an embodiment, the interior shell member has a length along the longitudinal axis shorter than a length of the exterior shell member along the longitudinal axis, the interior shell member being contained in the exterior shell member and surrounded by the concrete. The structural member can comprise at least one interior end spacing filled with concrete, the at least one interior end spacing being defined between an end of the interior shell member spaced-apart inwardly along the longitudinal axis from a corresponding end of the exterior shell member, and a length of the at least one interior end spacing being at least 10% of a length of the exterior shell member. The at least one reinforcement bar can comprise a transversally extending section extending from the longitudinally extending section into a respective one of the at least one interior end spacing, the longitudinally and transversally extending sections being embedded in the concrete. The at least one reinforcement bar can further comprise a second longitudinally extending section extending from the transversally extending section between the exterior shell member and the interior shell member.

In an embodiment, the at least one reinforcement bar comprises a plurality of reinforcement bars connected together to define a reinforced concrete armature embedded in the concrete and spaced-apart from the outer surface of the interior shell member and the inner surface of the exterior shell member.

In an embodiment, the longitudinally extending section of the at least one reinforcement bar extends past opposed ends of the interior shell member.

In an embodiment, the at least one reinforcement bar comprises a hook at a free end thereof.

In an embodiment, the inner channel of the interior shell member is at least partially hollow. Between about 30% and about 80% of a volume of the structural member can be hollow. The inner channel of the interior shell member can comprise opposed end sections filled with concrete and wherein each one of the opposed end sections can have a length and the length of each one of the opposed end sections can be about 5% to 20% of a length of the interior shell member.

In an embodiment, the at least one reinforcement bar is spaced apart from the inner surface of the exterior shell member and the outer surface of the interior shell member.

In an embodiment, the at least one reinforcement bar is embedded in the concrete.

In an embodiment, the structural member is an elongated beam and a central longitudinal axis of the interior shell member is decentered on a tension side of the elongated beam.

In an embodiment, the structural member is an elongated beam and the longitudinally extending section of the at least one reinforcement bar extends on a tension side of the elongated beam.

In an embodiment, at least one of the exterior shell member and the interior shell member comprises fiber reinforced polymer.

In an embodiment, a ratio of the diameters of the interior shell member and the exterior shell member is between about 0.2 and about 0.8.

In an embodiment, a length of the interior shell member is between about 30% to about 80% the length of the exterior shell member.

In an embodiment, at least one of the inner surface of the exterior shell member and the outer surface of the interior shell member comprises at least one of a concrete adherence enhancing coating and a plurality of concrete adherence enhancer.

In an embodiment, at least one of the inner surface of the exterior shell member and the outer surface of the interior shell member comprises a polymeric coating including abrasive particles.

In an embodiment, at least one of the inner surface of the exterior shell member and the outer surface of the interior shell member comprises a plurality of narrow grooves defined therein.

In an embodiment, at least one of the inner surface of the exterior shell member and the outer surface of the interior shell member comprises a plurality of spaced-apart pins protruding from a respective one of the inner surface of the exterior shell member and the outer surface of the interior shell member.

In an embodiment, at least one of the exterior shell member and the interior shell member comprises helicoidal fiber windings adjacent to a respective one of the inner surface and the outer surface.

According to another general aspect, there is provided a structural member having a longitudinal axis. The structural member comprises: an exterior shell member defining an elongated channel with an inner surface; an interior shell member having an outer surface and defining an inner channel, inserted in the elongated channel of the exterior shell member and extending longitudinally therein and defining an inter-shell spacing therebetween; and concrete filling the inter-shell spacing and including at least one reinforcement bar having a longitudinally extending section extending in the inter-shell spacing and being disconnected from the inner surface of the exterior shell member and from the outer surface of the interior shell member.

In an embodiment, each one of the interior shell member and the exterior shell member comprises two opposed ends, the ends of the inner shell member being spaced-apart inwardly along the longitudinal axis from a corresponding end of the exterior shell member. The ends of the interior shell member, spaced-apart inwardly along the longitudinal axis from the corresponding end of the exterior shell member, can be covered with the concrete.

In an embodiment, the interior shell member has a length along the longitudinal axis shorter than a length of the exterior shell member along the longitudinal axis, the interior shell member being contained in the exterior shell member and surrounded by the concrete. The structural member can further comprise at least one interior end spacing filled with concrete, defined between an end of the interior shell member spaced-apart inwardly along the longitudinal axis from a corresponding end of the exterior shell member, and a length of the at least one interior end spacing being at least 10% of a length of the exterior shell member. The at least one reinforcement bar can comprise a transversally extending section extending from the longitudinally extending section into a respective one of the at least one interior end spacing, the longitudinally and transversally extending sections being embedded in the concrete. The at least one reinforcement bar further can comprise a second longitudinally extending section extending from the transversally extending section in the inter-shell spacing.

In an embodiment, the at least one reinforcement bar comprises a plurality of reinforcement bars connected together to define a reinforced concrete armature embedded in the concrete and spaced-apart from the outer surface of the interior shell member and the inner surface of the exterior shell member.

In an embodiment, the at least one reinforcement bar comprises a hook at a free end thereof.

In an embodiment, the longitudinally extending section of the at least one reinforcement bar extends past opposed ends of the interior shell member.

In an embodiment, the inner channel of the interior shell member is hollow. Between about 30% and about 80% of a volume of the structural member can be hollow. The inner channel of the interior shell member can comprise opposed end sections filled with concrete and wherein each one of the opposed end sections can have a length and a length of each one of the opposed end sections can be about 5% to 20% of the length of the interior shell member.

In an embodiment, the at least one reinforcement bar is spaced apart from the inner surface of the exterior shell member and the outer surface of the interior shell member.

In an embodiment, the at least one reinforcement bar is embedded in the concrete.

In an embodiment, the structural member is an elongated beam and a central longitudinal axis of the interior shell member is decentered on a tension side of the elongated beam.

In an embodiment, the structural member is an elongated beam and the longitudinally extending section of the at least one reinforcement bar extends on a tension side of the elongated beam.

In an embodiment, at least one of the exterior shell member and the interior shell member comprises fiber reinforced polymer.

In an embodiment, a ratio of the diameters of the interior shell member and the exterior shell member is between about 0.2 and about 0.8.

In an embodiment, a length of the interior shell member is between about 30% to about 80% the length of the exterior shell member.

In an embodiment, at least one of the inner surface of the exterior shell member and the outer surface of the interior shell member comprises at least one of a concrete adherence enhancing coating and a plurality of concrete adherence enhancer.

In an embodiment, at least one of the inner surface of the exterior shell member and the outer surface of the interior shell member comprises a polymeric coating including abrasive particles.

In an embodiment, at least one of the inner surface of the exterior shell member and the outer surface of the interior shell member comprises a plurality of narrow grooves defined therein.

In an embodiment, at least one of the inner surface of the exterior shell member and the outer surface of the interior shell member comprises a plurality of spaced-apart pins protruding from a respective one of the inner surface of the exterior shell member and the outer surface of the interior shell member.

In an embodiment, at least one of the exterior shell member and the interior shell member comprises helicoidal fiber windings adjacent to a respective one of the inner surface and the outer surface.

According to still another general aspect, there is provided a composite structural member assembly comprising: at least two composite structural members as described above; and at least one connector assembly connecting together the at least two composite structural members mutually perpendicularly and including at least one structural member abutting plate and a plurality of anchors, the at least one structural member abutting plate being superposable to an outer surface of at least one of the at least two composite structural members, each one of the anchors having an inner section extending in at least a respective one of the at least two composite structural members and an outer end section extending beyond the outer surface of the respective one of the at least two composite structural members and engaged with a respective one of the at least one structural member abutting plate, the at least one structural member abutting plate and the plurality of anchors being configured to secure together the at least two composite structural members in a mutually perpendicular configuration.

In an embodiment, a first one of the at least two composite structural members is a beam and a second one of the at least two composite structural members is a column and at least two of the anchors extend in an interior end spacing of the beam, the interior end spacing being defined between an end of the interior shell member spaced-apart inwardly along the longitudinal axis from a corresponding end of the exterior shell member. At least two of the anchors can extend in the column transversally to its longitudinal axis.

In an embodiment, at least two of the anchors are "L"-shaped anchors embedded in the concrete.

In an embodiment, the at least one structural member abutting plate comprises at least two structural member abutting plates, each one of the structural member abutting plates abutting an outer surface of a respective one of the composite structural members. At least two of the anchors can be straight anchors extending throughout the respective one of the composite structural members and having two opposed outer end sections, each one of the outer end sections being engaged with a respective one of the structural member abutting plates abutting opposite outer surfaces of the respective one of the composite structural members.

In an embodiment, the outer end section of the anchors is engaged with the respective one of the at least one structural member abutting plate through a retainer.

According to a further general aspect, there is provided a process for manufacturing a structural member. The process comprises: inserting an interior shell member having an inner channel in an elongated channel of an exterior shell member; inserting at least one reinforcement bar in an inter-shell spacing defined between the exterior shell member and the interior shell member; and filling the inter-shell spacing with concrete with the at least one reinforcement bar being embedded in the concrete.

In an embodiment, the process further comprises providing a concrete adherence improvement treatment to at least one of the inner surface of the exterior shell member, the outer surface of the interior shell member, and the inner surface of the interior shell member, the concrete adherence improvement treatment promoting cohesion between the treated surface and the concrete. Improving the concrete adherence further can comprise: applying a resin to the at least one of the inner surface of the exterior shell member, the outer surface of the interior shell member, and the inner surface of the interior shell member; and applying a granular material to the unset resin; adhering helicoïdal fiber windings to the at least one of the inner surface of the exterior shell member, the outer surface of the interior shell member, and the inner surface of the interior shell member; securing pins to the at least one of the inner surface of the exterior shell member, the outer surface of the interior shell member and the inner surface of the interior shell member; and machining grooves on the at least one of the inner surface of the exterior shell member, the outer surface of the interior shell member, and the inner surface of the interior shell member.

In an embodiment, inserting the at least one reinforcement bar in the inter-shell spacing comprises inserting plastic chairs in the inter-shell spacing to support the at least one reinforcement bar, spaced-apart from the inner surface of the exterior shell member and the outer surface of the interior shell member.

In an embodiment, the process further comprises inserting obstructing members in the inner channel of the interior shell member, the obstructing members being spaced apart from one another and each one being close to an opposed end of the interior shell member. Inserting the obstructing members in the inner channel of the interior shell member can comprise inserting the obstructing members in the inner channel, spaced-apart inwardly from the opposed ends of the interior shell member.

In an embodiment, the interior shell member has a length along the longitudinal axis shorter than a length of the exterior shell member along the longitudinal axis, and wherein inserting the interior shell member in the elongated channel of the exterior shell member with two opposed ends of the inner shell member being spaced-apart inwardly along the longitudinal axis from a corresponding end of the exterior shell member defining interior end spacings therebetween. Filling the inter-shell spacing with concrete can comprise covering the ends of the inner shell member with the concrete. The process can further comprise bending the at least one reinforcement bar to obtain a longitudinally extending section, extending along the longitudinal axis of the composite structural member, and a transversally extending section extending in one of the interior end spacings.

In an embodiment, filling the inter-shell spacing with the concrete can comprise filling opposed end sections of the inner channel with the concrete.

BRIEF DESCRIPTION OF THE DRAWINGS

FIG. 6 includes FIGS. 6A and 6B, FIG. 6A is a side elevation view, fragmented, of two composite structural members connected together in accordance with a first two-connected-member implementation, wherein the composite structural members are connected through a beam with structural member abutting plates, and FIG. 6B is a sectional view taken along section lines 6B-6B of FIG. 6A;

FIG. 7 includes FIGS. 7A and 7B, FIG. 7A is a side elevation view, fragmented, of two composite structural members connected together in accordance with a second two-connected-member implementation, wherein the composite structural members are connected through two structural member abutting plates, and FIG. 7B is a sectional view taken along section lines 7B-7B;

FIG. 8 includes FIGS. 8A and 8B.

FIG. 9 includes FIGS. 9A and 9B.

FIG. 10 includes FIGS. 10A and 10B.

FIG. 11 includes FIGS. 11A and 11B.

FIG. 12 includes FIGS. 12A and 12B.

FIG. 13 includes FIGS. 13A and 13B.

FIG. 14 includes FIGS. 14A and 14B.

FIG. 15 includes FIGS. 15A and 15B.

FIG. 16 includes FIGS. 16A and 16B.

FIG. 17 includes FIGS. 17A and 17B.

FIG. 18 includes FIGS. 18A and 18B.

FIG. 19 includes FIGS. 19A and 19B.

FIG. 20 includes FIG. 20A, FIG. 20B, and FIG. 20C.

FIG. 24 includes FIG. 24A, FIG. 24B, and FIG. 24C.

DETAILED DESCRIPTION

Figure 1:
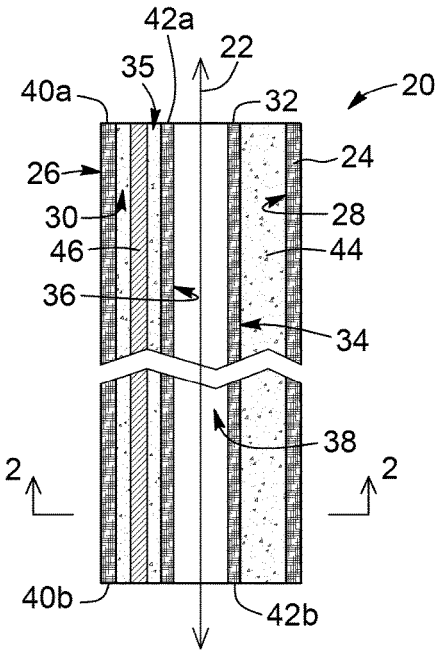
FIG. 1 is a sectional view taken along section lines 1-1 of FIG. 2 of a composite structural member in accordance with an embodiment, wherein the composite structural member has a circular cross-section.
Figure 2:
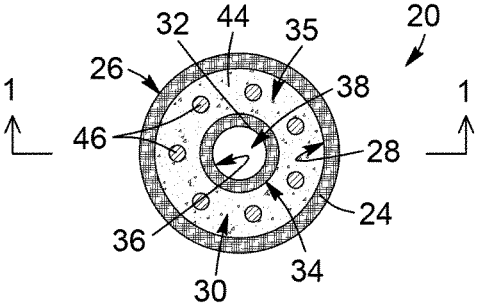
FIG. 2 is a sectional view taken along section lines 2-2 of FIG. 1 of the composite structural member shown in FIG. 1.

Referring now to the drawings and, more particularly, referring to FIGS. 1 and 2, there is shown a first embodiment of a composite structural member 20 having a longitudinal axis 22. The composite structural member 20 is typically used as a column in structural applications. The composite structural member 20 comprises an exterior shell member 24 having an outer surface 26 and an inner surface 28.

The outer surface 26 defines an outer peripheral shape of the composite structural member 20. The inner surface 28 defines an elongated channel 30 extending along the longitudinal axis 22. The composite structural member 20 further comprises an interior shell member 32 inserted in the exterior shell member 24 and, more particularly, in the elongated channel 30. In the embodiment shown, the interior shell member 32 extends along the entire elongated channel 30 of the exterior shell member 24. The interior shell member 32 has an outer surface 34 and an inner surface 36. The inner surface 36 defines an elongated inner channel 38. The outer surface 34 is spaced-apart from the inner surface 28 of the exterior shell member 24. In the embodiment shown, both the exterior shell member 24 and the interior shell member 32 have a circular cross-section and are concentric. Thus, the inner surface 28 of the exterior shell member 24 and the outer surface 34 of the interior shell member 32 are substantially evenly spaced-apart along an entire length of the interior shell member 32 and an elongated inter-shell spacing 35 is defined therebetween. In the embodiment shown, the elongated inter-shell spacing 35 has a substantially annular cross-section along the entire length of the composite structural member 20.

For instance and without being limitative, a ratio of the diameters of the interior shell member 32 and the exterior shell member 24 is between about 0.2 and about 0.8. For substantially rectangular shell members 24, 32, the diameter is intended to mean a length of a diagonal extending between opposed corners of the rectangular shell member 24, 32.

Each one of the exterior shell member 24 and the interior shell member 32 comprises two ends 40*a*, 40*b* and 42*a*, 42*b*, respectively. In the embodiment shown in FIGS. 1 and 2, the exterior shell member 24 and the interior shell member 32 have substantially the same length along the longitudinal axis 22 and the two ends are aligned. However, in an alternative embodiment, as will be described in more details below, the interior shell member 32 can be shorter than the exterior shell member 24 and at least two of the ends 40*a*, 40*b*, 42*a*, 42*b* can be spaced-apart along the longitudinal axis 22, with the interior shell member 32 being contained in the elongated channel 30.

The composite structural member 20 further comprises reinforced concrete 44 in the elongated inter-shell spacing 35. More particularly, concrete 44 fills the elongated inter-shell spacing 35 between the inner surface 28 of the exterior shell member 24 and the outer surface 34 of the interior shell member 32. The concrete 44 comprises a plurality of reinforcement bars 46 extending mainly along the longitudinal axis of the composite structural member 20 to form reinforced concrete. The reinforcement bars 46 are not connected to either the exterior shell member 24 or the interior shell member 32, but can be connected to one another to define a reinforced concrete armature. The reinforcement bars, connected together or not, for the reinforced concrete armature.

In the embodiment shown, they are disconnected and spaced-apart from the exterior shell member 24 and the interior shell member 32, and are substantially uniformly spaced-apart from one another in the elongated inter-shell spacing 35 and surrounded by concrete. It will be appreciated that the number of reinforcement bars 46 and their disposition inside the inter-shell spacing 35 can vary from the embodiment shown. For instance and without being limitative, for beams, the reinforcement bars 46 can be provided mainly on a tension side of the beam. The reinforcement bars 46, disconnected and spaced-apart from the exterior shell member 24 and the interior shell member 32, increase the bending capacity of composite structural member 20.

To maintain the reinforcement bars 46 spaced-apart from the exterior shell member 24 and the interior shell member 32 and the interior shell member 32 spaced-apart from the exterior shell member 24 when concrete is poured in the inter-shell spacing 35, plastic chairs (or spacers) can be used to support the reinforcement bars 46 and the interior shell member 32 inside the exterior shell member 24.

To reduce the weight of the composite structural member 20, the elongated inner channel 38 defined by the inner surface 36 of the interior shell member 32 is hollow. However, in an alternative embodiment, it can be filled with a relatively light material, i.e. lighter than concrete, to reduce the weight of the composite structural member 20 while improving the mechanical performances.

If the elongated inner channel 38 of the composite structural member 20 is substantially hollow, the ends are obstructed when pouring concrete in the inter-shell spacing 35 to substantially prevent concrete infiltration therein. For instance, the ends can be obstructed with an obstructing member closing the ports of the inner channel 38. For instance and without being limitative, wood plates can be mounted to the ends 42*a*, 42*b* of the interior shell member 32 to prevent concrete infiltration in the elongated inner channel 38.

The exterior shell member 24 can be made of any of several suitable materials. For instance and without being limitative, it can include fiber reinforced polymer (FRP), steel, aluminum and aluminum alloys. It can also include two or more layers of similar or different material superposed on one another. In a particular embodiment, the exterior shell member 24 comprises fiber reinforced polymer (FRP).

The interior shell member 32 can be made of several suitable materials. For instance and without being limitative, it can include FRP, steel, aluminum, aluminum alloys, PVC and cardboard. It can also include two or more layers of similar or different material superposed on one another.

In an embodiment, the stiffnesses of the exterior shell member 24 and the interior shell member 32 are in a similar range.

If one or both of the exterior and interior shell members 24, 32 are made of FRP, they can be manufactured by filament winding, pultrusion, or any other suitable manufacturing processes. To modify the mechanical properties of the composite structural member 20, the number of layers and the orientation of the fibers can be adjusted.

The reinforcement bars 46 can be made of several suitable materials. For instance and without being limitative, they can be made of steel or composite materials such as fiber reinforced polymer bars. In the embodiment shown, the reinforcement bars 46 have a substantially circular cross-section. However, in an alternative embodiment, the cross-sectional shape of the reinforcement bars 46 can vary from the embodiment shown. For instance and without being limitative, the cross-sectional shape of the reinforcement bars 46 can be square, rectangular, triangular, trapezoidal, and the like.

Similarly, in the embodiment shown, the cross-sectional shape of the composite structural member 20, defined by the outer surface 26 of the exterior shell member 24, is substantially circular. However, in an alternative embodiment, the cross-sectional shape of the composite structural member 20 can vary from the embodiment shown. For instance and without being limitative, the cross-sectional shape of the composite structural member 20 can be substantially square, rectangular, triangular, and the like. The composite structural member 20 can have rounded corners to avoid damage due to stress concentration. For instance, the exterior shell member 24 can have a substantially rectangular cross-section with rounded corners.

In the embodiment, the exterior shell member 24 and the interior shell member 32 have substantially the same cross-sectional shape. However, in an alternative embodiment, the cross-sectional shape of the interior shell member 32 can differ from the cross-sectional shape of the exterior shell member 24.

In the embodiment shown, the exterior and interior shell members 24, 32 are concentric, i.e. their centers are aligned. However, in an alternative embodiment, the centers of exterior and interior shell members 24, 32 can be offset.

In the embodiment shown, the cross-section of the exterior and interior shell members 24, 32 is substantially uniform along their entire length, i.e. the exterior and interior shell members 24, 32 have a substantially uniform diameter/perimeter along their length. However, in an alternative embodiment (not shown), the cross-section of the exterior and/or interior shell members 24, 32 can vary along the length of the respective one of the exterior and/or interior shell members 24, 32. For instance, the exterior and/or interior shell members 24, 32 can be wider along a section thereof corresponding to a connection between two mutually perpendicular composite structural members, i.e. a beam and a column, providing increase retention of anchors in concrete, as will be described in more details below.

In an alternative embodiment, for beams, the interior shell member 32 can be shifted to the tension zone of the composite structural member 20. Thus, the interior shell member 32 acts as flexural reinforcement and supports the concrete 44, as will be described in more detail below in reference to FIGS. 3 and 4. Thus, when assembled in a structural application, a center of the interior shell member 32 is in the lower half portion of the composite structural member 20.

To promote concrete adhesion on the inner surface 28 of the exterior shell member 24 and the outer surface 34 of interior shell member 32, a concrete adherence improvement treatment can be applied before filling the inter-shell spacing 35 with concrete. The concrete adherence improvement treatment can include a concrete adherence improvement coating or other suitable concrete adherence enhancer to roughened the surface and thereby improve concrete adherence. For instance, at least one of the surfaces 28, 34 can be covered with a relatively thin polymeric layer, such as a resin. Then, a thin coating of sand or other suitable particles, which can be abrasive particles, can be applied on the polymeric coating while it is still sufficiently adhesive to bond the particles. The polymeric coating promotes adhesion of the particles on the surface of the shell members 24, 32. In one version of this embodiment, the particle size of the abrasive material is selected to promote concrete adhesion on the surface of the shell members 24, 32. For instance and without being limitative, the polymeric coating can include polymers used for PRF manufacturing, epoxy, polyester, vinylester, and the like.

Other adherence improvement treatments can be applied before filling the inter-shell spacing 35 with concrete. For instance, it can include adhering granular material to a resin on the surface of the tube(s), machining relatively narrow grooves on the surface of the tube(s), coiling helicoidal fibers around the tube(s), and mounting protruding members, such as pins, to the surface of the tube(s) by gluing, screwing, or any other suitable assembly method.

The concrete adherence improvement treatment or concrete adherence enhancer described above can also be applied to the inner surface 36 of the interior shell member 32. Optionally, the treatment can be applied only on one or more sections of the inner surface 36 of the interior shell member 32. For instance, the treatment can be applied to end sections of the inner surface 36 of the interior shell member 32 if concrete is filled at least partially therein, as will be described in more detail below.

As mentioned above, one embodiment of concrete adherence enhancer uses relatively narrow grooves machined on at least one of the inner surface 28 of the exterior shell member 24 and the outer surface 34 of interior shell member 32 to promote concrete adhesion. In a different embodiment, helicoidal fiber windings are adhered to at least one of the inner surface 28 of the exterior shell member 24 and the outer surface 34 of interior shell member 32 to promote concrete adhesion. It is appreciated that pins can also be mounted to at least one of the inner surface 28 of the exterior shell member 24 and the outer surface 34 of interior shell member 32 to promote concrete adhesion. For instance, plastic, aluminum, steel, or composite material pins can be adhesively mounted, such as glued, or mechanically mounted, such as screwed, to the surface of the shell members 24, 32.

Depending on the application, it is possible that only one of the inner surface 28 of the exterior shell member 24 and the outer surface 34 of interior shell member 32 includes a concrete adherence improvement treatment or concrete adherence enhancer. Alternatively, both the inner surface 28 of the exterior shell member 24 and the outer surface 34 of the interior shell member 32 can include such a treatment or enhancer. The concrete adherence improvement treatment applied to the inner surface 28 of the exterior shell member 24 and the outer surface 34 of interior shell member 32 can be the same or can be different.

In the composite structural member 20, the exterior shell member 24 provides a permanent formwork, a flexural reinforcement, and a replacement of shear reinforcement. Furthermore, in some implementations wherein the reinforcement bars 46 are embedded in concrete and surrounded by the exterior shell member 24, the exterior shell member 24 provides corrosion protection for the concrete 44 and the embedded reinforcement bars 46.

The reinforced concrete 44 acts as a compression member in addition to supporting the exterior and interior shell members 24, 32 against buckling, as will be described in more detail below. The reinforced concrete armature including the reinforcement bars 46 is used as tension device to strengthen and hold the concrete in tension. In some beam implementations, the reinforcement bars 46 reinforce the composite structural member 20 on the tension side.

As mentioned above, the composite structural member 20 has a lower weight than conventional structural members due to its hollow inner channel 38. For instance and without being limitative, between about 30% and about 80% of a volume of the composite structural member 20 is hollow.

Figure 3:
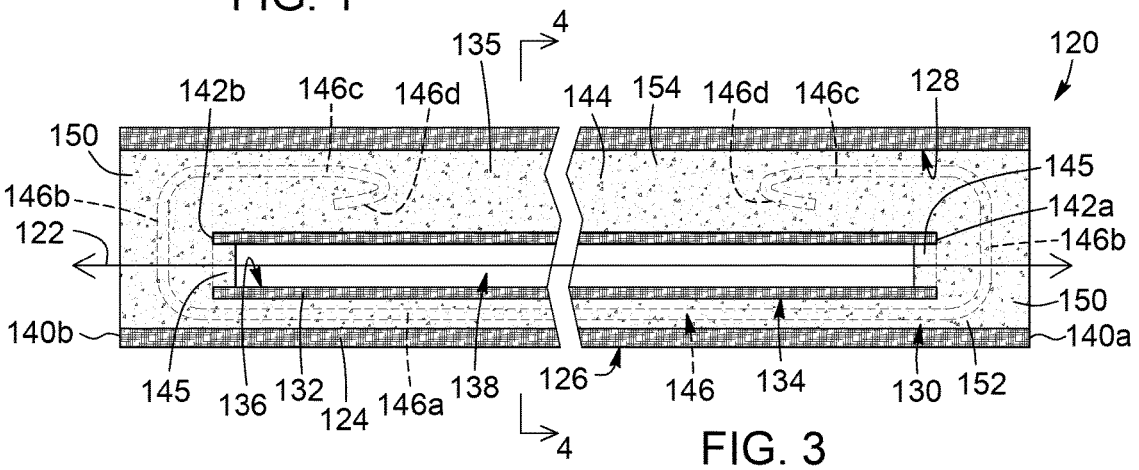
FIG. 3 is a sectional view taken along section lines 3-3 of FIG. 4 of the composite structural member in accordance with a second embodiment, wherein the composite structural member has a rectangular cross-section.
Figure 4:
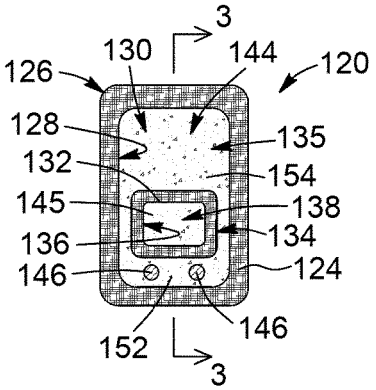
FIG. 4 is a sectional view taken along section lines 4-4 of the structural member shown in FIG. 3.

Referring to FIGS. 3 and 4, there is shown an alternative embodiment of the composite structural member 20 wherein the features are numbered with reference numerals in the 100 series which correspond to the reference numerals of the previous embodiment. In the embodiment shown in FIGS. 3 and 4, each of the exterior and interior shell members 124, 132 has a substantially rectangular cross-section with rounded corners and their respective centers are spaced-apart from each other, as will be described in more detail below. The composite structural member 120 can be used as a beam in structural applications.

Furthermore, the exterior shell member 124 is longer than the interior shell member 132 along the longitudinal axis 122. Therefore, an interior end spacing 150 is defined between the ends 140*a*, 140*b* of the exterior shell member 124 and the ends 142*a*, 142*b* of the interior shell member 132, respectively. The ends 142*a*, 142*b* of the interior shell member 132 are located within the elongated channel 130. Like the inter-shell spacing 135, the interior end spacing 150 is filled with concrete. The inner channel 138 of the interior shell member 132 is substantially empty to keep down the weight of the composite structural member 120.

In an embodiment, a length of the interior shell member 132 is between about 30% to about 80% the length of the exterior shell member 124. In an embodiment and without being limitative, the length of the interior end spacing 150 is at least 10% of the length of the exterior shell member 124 to allow insertion of a connector assembly, as will be described in more detail below.

In the embodiment shown, at least some of the reinforcement bars 146 extend continuously from the inter-shell spacing 135 into the interior end spacing 150 to increase the bond between the reinforcement bars 146 and concrete. In some embodiments, at least some of the reinforcement bars extend continuously parallel to the longitudinal axis 122 in the inter-shell spacing 135 on a first side of the composite structural member 120, are bent and extend continuously in the interior end spacing 150, and can be bent and extend partially or continuously in the inter-shell spacing 135 on a second side of the composite structural member 120 to further increase the bond with concrete.

In the embodiment shown in FIGS. 3 and 4, the interior shell member 132 of the composite structural member 120, which can be used as a beam, is located in the tension zone of the composite structural member 120. In other words, the exterior shell member 124 and the interior shell member 132 are not concentric, a longitudinal axis of the interior shell member 132 being offset from a longitudinal axis of the exterior shell member 124. If this configuration is used in flexion, the interior shell member 132 acts as a flexural reinforcement and supports the concrete 144. To further utilize partial or full capacity of the interior shell member 132, concrete is poured at a specified length from the opposed ends 142*a*, 142*b* of the interior shell member 132. Thus, the inner channel 138 of the interior shell member 132 comprises opposed end sections 145, extending inwardly from the opposed ends 142*a*, 142*b* thereof, which are filled with concrete. In a non-limitative embodiment, each one of the opposed end sections 145 of the inner channel 138 has a length which is between about 5% and about 20% of the length of the interior shell member. In an embodiment, the inner channel 138, between the end sections 145 filled with concrete, is hollow. Concrete poured in the end sections 145 of the inner channel 138 increases the mechanical properties of the resulting composite structural member with the interior shell member acting as an armature of the composite structural member 120.

When end sections 145 of the inner channel 138 are filled with concrete but a middle section of the inner channel 138, extending between the end sections 145 is hollow, obstructing members, such as plates, are inserted in the inner channel 138, spaced-apart inwardly from ends 142*a*, 142*b* to substantially prevent concrete infiltration into the middle section but to fill the end sections 145 with concrete. For instance and without being limitative, wood plates can be inserted in the inner channel 138 of the interior shell member 132 to prevent concrete infiltration in the middle section of the inner channel 38.

The concrete thickness on a first side 152 of the composite structural member 120, i.e. the tension side of the beam, is thinner than on a second side 154, opposed to the first side 152, i.e. the compression side of the beam.

The composite structural member 120 shown in FIGS. 3 and 4 comprises two reinforcement bars 146 having a first longitudinally extending section 146*a* which extends continuously in the inter-shell spacing 135 on the first side 152, i.e. on the tension side of the composite structural member 120. The two reinforcement bars 146 are bent to form second transversally extending sections 146*b* that extend continuously in a lateral direction in the two interior end spacings 150 located at opposite ends of the composite structural member 120. The two reinforcement bars 146 are further bent to form third sections 146*c* that extend partially in the inter-shell spacing 135 on the second side 154 of the composite structural member 120, i.e. the compression side of the composite structural member 120. In an exemplary version of this embodiment, the third sections 146*c* are substantially parallel to the first sections 146*a*. Ends of the two reinforcement bars 146 are further bent to form relatively short fourth sections 146*d* that extend in the inter-shell spacing 135 on the second side 154 to form hooks. Hooks defined at the ends of the reinforcement bars 146 substantially prevents displacement of the reinforced concrete armature inside concrete.

As for the above-described embodiment, the number, the disposition, and the configuration of the reinforcement bars 146 forming the reinforced concrete armature can vary from the embodiment shown.

In addition, the inner surface 128 of the exterior shell member 124 and the outer surface 134 of interior shell member 132 can include a concrete adherence improvement treatment to promote cohesion with concrete.

As shown in FIGS. 3 and 4, the interior shell member 132 and the reinforcement bars 146 are entirely surrounded by concrete to promote the bond between concrete, the interior shell member 132, and the reinforcement bars 146. They are not visible from the outside. In an alternative embodiment, part of the interior shell member 132 and the reinforcement bars 146 are visible.

Figure 5:
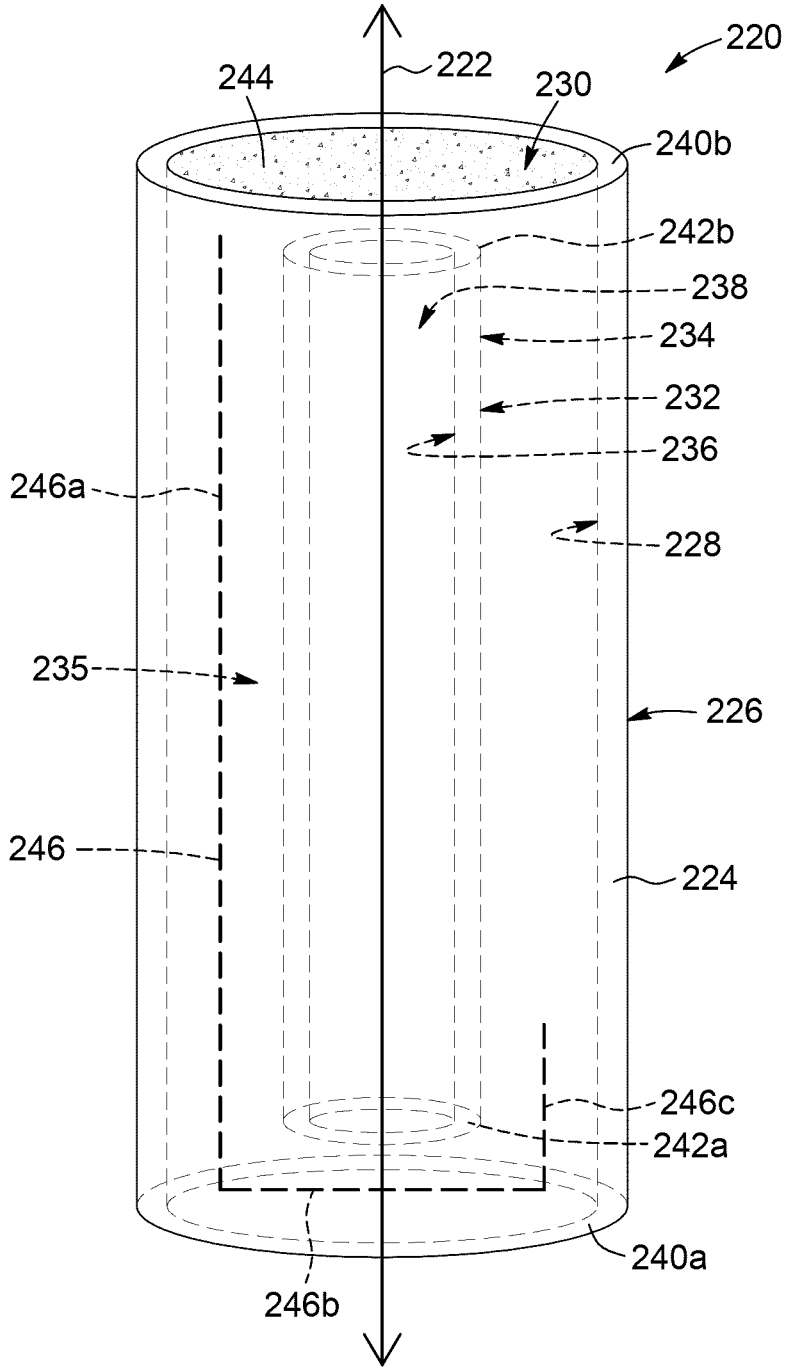
FIG. 5 is a schematic front elevation view of the composite structural member in accordance with a third embodiment, wherein the composite structural member has a circular cross-section.

Referring to FIG. 5, there is shown an alternative embodiment of the composite structural member wherein the features are numbered with reference numerals in the 200 series which correspond to the reference numerals of the previous embodiments. In the embodiment shown in FIG. 5, the exterior and interior shell members 224, 232 have a substantially circular cross section and they are substantially concentric. The composite structural member 220 can be used as a column in structural applications.

Furthermore, the exterior shell member 224 is longer than the interior shell member 232 along the longitudinal axis 222 and extends past the interior shell member 232 at ends 240*a*, 240*b*, 242*a*, 242*b*. Therefore, the composite structural member 220 comprises two interior end spacings 250 which are filled with concrete. Once again, the inner channel 238 of the interior shell member 232 is empty to keep down the weight of the composite structural member 220. In the embodiment shown, the composite structural member 220 is represented with only one reinforcement bar 246. However, it is appreciated that the reinforced concrete armature of the composite structural member 220 can include several reinforcement bars, which can be connected to one another, and the number, the disposition, and the configuration of the reinforcement bars can vary. The reinforcement bar 246 extends continuously from the inter-shell spacing 235 into one of the interior end spacings 250. More particularly, the reinforcement bar 246 has a first longitudinally extending section 246*a* extending continuously substantially parallel to the longitudinal axis 222 in the inter-shell spacing 235 on the first side 252 of the composite structural member 220, is bent to form a second transversally extending section 246*b* extending continuously in the interior end spacing 250 in a lateral direction, and is further bent to form a third section 246*c* extending partially in the inter-shell spacing 235 on the second side 254 of the composite structural member 220. The three sections 246*a*, 246*b*, 246*c* form a hook which substantially prevents displacement of the reinforced concrete armature inside concrete. The interior shell member 232 and the reinforcement bar 246 are entirely surrounded by concrete and are not visible from the outside.

In one version of the FIG. 5 embodiment, concrete can be poured in the inner channel 238 at a specified length from the ends 242*a*, 242*b* of the interior shell member 232 to increase the mechanical properties of the resulting composite structural member, as detailed above in reference to FIGS. 3 and 4. Thus, the elongated inner channel 238 is not entirely empty but end sections thereof are filled with concrete. Alternatively, only one of the end sections can be filled with concrete. As with the aforementioned embodiments, the elongated inner channel 238 can be entirely or partially filled with another lighter material than concrete.

As with the above-described embodiments, the inner surface 228 of the exterior shell member 224 and the outer surface 234 of interior shell member 232 can include a concrete adherence improvement treatment or a concrete adherence enhancer to promote cohesion with concrete.

The reinforced concrete armature can optionally comprise one or more transversally extending reinforcement members (not shown) defining a loop surrounding the interior shell member 32, 132, 232 and extending between the inner surface 28, 128, 228 of the exterior shell member 24, 124, 224 and the outer surface 34, 134, 234 of the interior shell member 32, 132, 232. As the longitudinally extending reinforced members, the transversally extending reinforcement members are spaced-apart of and disconnected from the exterior shell member 24, 124, 224 and the interior shell member 32, 132, 232. While the exterior shell member 24, 124, 224 can provide the required shear strength, if needed, the use of such transversal reinforcement member(s), which can also be referred to as stirrups, inside concrete 44, 144, 244, can increase the shear resistance. In an embodiment, the composite structural member is free of transversally extending reinforcement member.

As for the embodiment described in reference to FIGS. 1 and 2, the composite structural members 120, 220 can include a wider section along their length. The wider section can be aligned with connector(s) to connect two or more two mutually perpendicular composite structural members, i.e. beam(s) and a column.

Referring now to FIG. 6, there is shown an implementation of a connection between two mutually perpendicular structural composite members 320*a*, 320*b*, i.e. a connection between a beam 320*a* and a column 320*b*.

To simplify the figures in the below described implementations of connector assemblies, the inner structure of the structural composite members is not entirely shown. Solely, the elongated inner channel is schematically represented. However, it is appreciated that the structural composite members have an internal structure including a reinforced concrete armature as described above in reference to FIGS. 1 to 5.

More particularly, the structural composite members 320*a*, 320*b* are connected through a connector 360. The connector 360 is substantially an I-beam 362 with two structural member abutting plates 364. Each of the structural composite members 320*a*, 320*b* is manufactured with four anchors 366 having a first section extending therein and a second section extending outwardly. In the implementation shown, the anchors 366 are substantially "L"-shaped anchors. It is appreciated that the shape, the number and the configuration of the anchors 366 can vary from the implementation shown. Four apertures are defined in each of the structural member abutting plates 364 of the connector 360 and the second section, i.e. the end section, of the anchors 366 extending outwardly are inserted in a respective one of the four apertures. The outer surfaces 326 of the structural composite members 320*a*, 320*b* are juxtaposed to a respective one of the structural member abutting plates 364 of the connector 360 and the anchors 366 are secured in this engaged configuration. For instance, at least part of the end section of the anchors 366 can be threaded and retaining elements, such as nuts, can be attached to secure the anchors 366 to the connector 360 and, more particularly, the structural member abutting plates 364.

In an embodiment, the "L"-shaped anchors 366 are inserted in the inter-shell spacing before pouring concrete therein. When concrete is poured in the inter-shell spacing, the anchors 366 are secured therewith.

As shown in FIG. 6A, anchors 366 can extend mainly along either substantially parallel or normal to the longitudinal axis of the structural composite members 320*a*, 320*b*. For beam 320*a*, the anchors 366 extend in the interior end spacings filled with concrete, i.e. between an exterior shell member and the adjacent end of the interior shell member. Sections of the reinforced concrete armature can also extend in the interior end spacings, as described above. For column 320*b*, a section of the anchors 366 extend through the elongated inner channel 338, perpendicularly thereto. The end sections of the "L"-shaped anchors 366 extending in the beam 320*b* are located inside concrete to enhance bond with the column 320*b*.

In an embodiment, the anchors 366 can be provided in pairs with their inner end sections extending in opposite directions as shown in FIG. 6A.

When engaged with the interior and exterior shell members, an end section of the anchors 366 extend outwardly of the outer surface 326 of the structural composite members 320*a*, 320*b*. As shown in the figures, the end section of the anchors extending outwardly of the structural composite members 320*a*, 320*b* can be threaded. In an embodiment, the anchors 366 are positioned to not interfere with the reinforcement bars 46, 146, 246 extending in the inter-shell spacing 35, 135, 235.

Referring now to FIG. 7, there is shown an alternative implementation of a connection between two mutually perpendicular structural composite members 420*a*, 420*b* wherein the features are numbered with reference numerals in the 400 series which correspond to the reference numerals of the above-described implementation. Once again, the structural composite members 420*a*, 420*b*, i.e. a beam 420*a* and a column 420*b*, are connected through a connector assembly 460. The connector assembly 460 comprises two substantially rectangular structural member abutting plates 470 and a plurality of straight anchors 466. The anchors 466 have a middle section that extends through the structural composite member 420*a*, 420*b* and two end sections extending outwardly of a respective one of the structural composite members 420*a*, 420*b*.

Each one of the structural member abutting plates 470 comprises eight apertures, four of the apertures being associated with each one of the structural composite members 420*a*, 420*b*, respectively. The anchors 466 are inserted through each of the structural composite members 420*a*, 420*b* with end sections thereof extending outwardly on each side of the structural composite members 420*a*, 420*b*. The structural member abutting plates 470 are engaged with the anchors 466 by inserting the end sections into respective ones of the apertures. Each one of the apertures of a first one of the structural member abutting plates 470 is aligned with a respective one of the apertures of a second one of the plates 470. The structural member abutting plates 470 are juxtaposed to the outer surfaces 426 of the structural composite members 420*a*, 420*b*, each one of the plates 470 extending on a respective side of the structural composite members 420*a*, 420*b*. The anchors 466 and the structural member abutting plates 470 are secured together in this engaged configuration. For instance, at least part of the end sections of the anchors 466 can be threaded and retaining elements, such as nuts, can be attached thereto to secure the anchors 466 to the structural member abutting plates 470.

The anchors 466 can be engaged with the exterior shell member before pouring concrete in the inter-shell spacing. When concrete is poured in the inter-shell spacing, the anchors 466 are embedded therewith. Alternatively, molding elements can be inserted between the exterior and interior shell members before pouring concrete therein to define hollow channels in the composite structural members 420*a*, 420*b*. Straight anchors 466 can be subsequently inserted in the hollow channels to connect two composite structural members 420*a*, 420*b* together.

Straight anchors 466 extend substantially normal to the longitudinal axis of the structural composite members 420*a*, 420*b*. For beam 420*a*, the anchors 466 extend in the interior end spacings filled with concrete, i.e. between an exterior shell member and the adjacent end of the interior shell member. Sections of the reinforced concrete armature can also extend in the interior end spacings, as described above. For column 420*b*, a section of the anchors 466 extend partially through the elongated inner channel 438, perpendicularly thereto.

Referring now to FIG. 8, there is shown a third implementation of a connection between two mutually perpendicular structural composite members 520*a*, 520*b*, i.e. a beam 520*a* and a column 520*b*, wherein the features are numbered with reference numerals in the 500 series which correspond to the reference numerals of the previous implementations. Once again, the structural composite members 520*a*, 520*b* are connected through a connector assembly 560. The connector assembly 560 includes a substantially rectangular structural member abutting plate 570 having four apertures defined therein and four anchors 566. The structural composite member 520*a*, i.e. the bean, is manufactured with four anchors 566 having a first section extending therein and a second section extending outwardly. In the implementation shown, the anchors 566 are substantially "L"-shaped anchors that have a first section that is embedded in the structural composite member 520*a*, in the interior end spacings filled with concrete. It is appreciated that the shape, the number and the configuration of the anchors 566 can vary from the implementation shown. Hollow channels are defined through the structural composite member 520*b*, i.e. the column, as described above in reference to FIG. 7. The structural composite members 520*a*, 520*b* are arranged in a relative perpendicular configuration with the second section of each of the anchors 566 being inserted in a respective one of the hollow channels of structural composite member 520*b*. A portion of each anchor 566 passes through a respective one of the plate apertures, and is secured by a retaining element on the opposite side of the structural member abutting plate 570. In the implementation shown, the end portion of each anchor 566 is threaded, and retaining elements, such as nuts, are used to secure the anchors 566 to the structural member abutting plate 570.

The "L"-shaped anchors 566 are inserted in the interior end spacings of beam 520*a* before pouring concrete in the inter-shell spacing. Therefore, the "L"-shaped anchors 566 are embedded in concrete filling the interior end spacings of beam 520*a*.

Figures 8A, 8B:
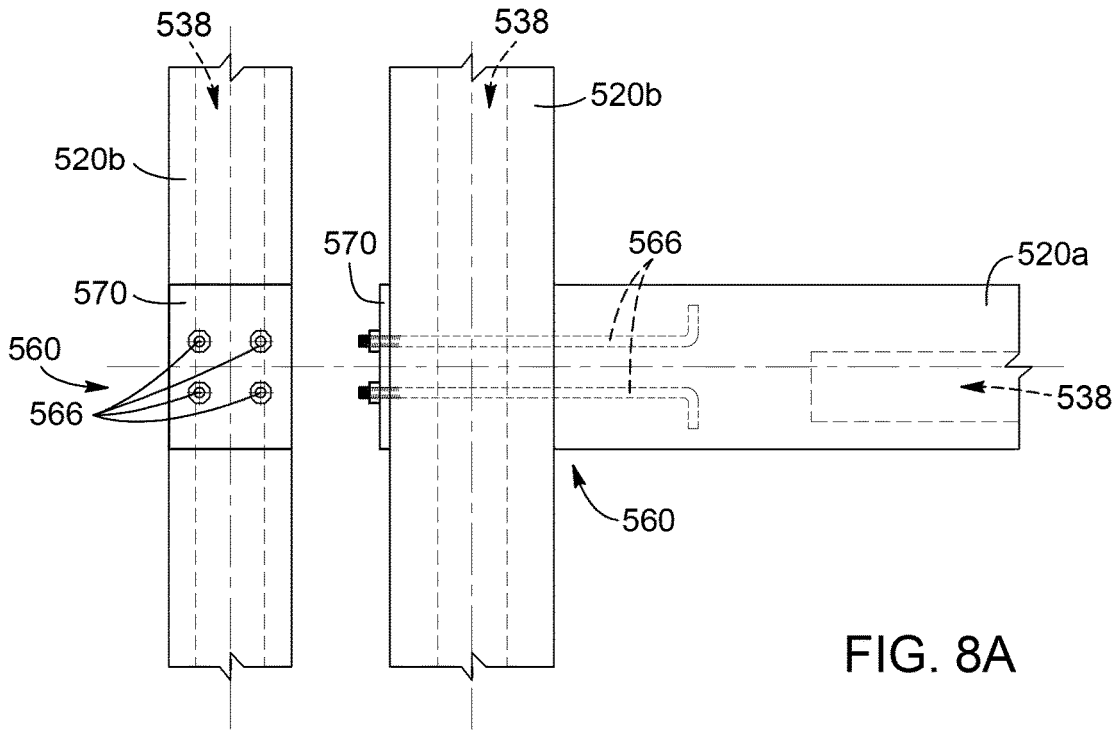
FIG. 8A is a side elevation view, fragmented, of two composite structural members connected together in accordance with a third two-connected-member implementation, wherein the composite structural members are connected through a combination of a structural member abutting plate and inwardly extending anchors.
FIG. 8B is a front elevation view of the two composite structural members shown in FIG. 8A.

As shown in FIG. 8A, anchors 566 extend mainly substantially parallel to the longitudinal axis of beam 520*a* and normal to the longitudinal axis of column 520*b*. The anchors 566 can be provided in pairs and their inner sections extend in opposite directions as shown in FIG. 8A.

Figure 9A:
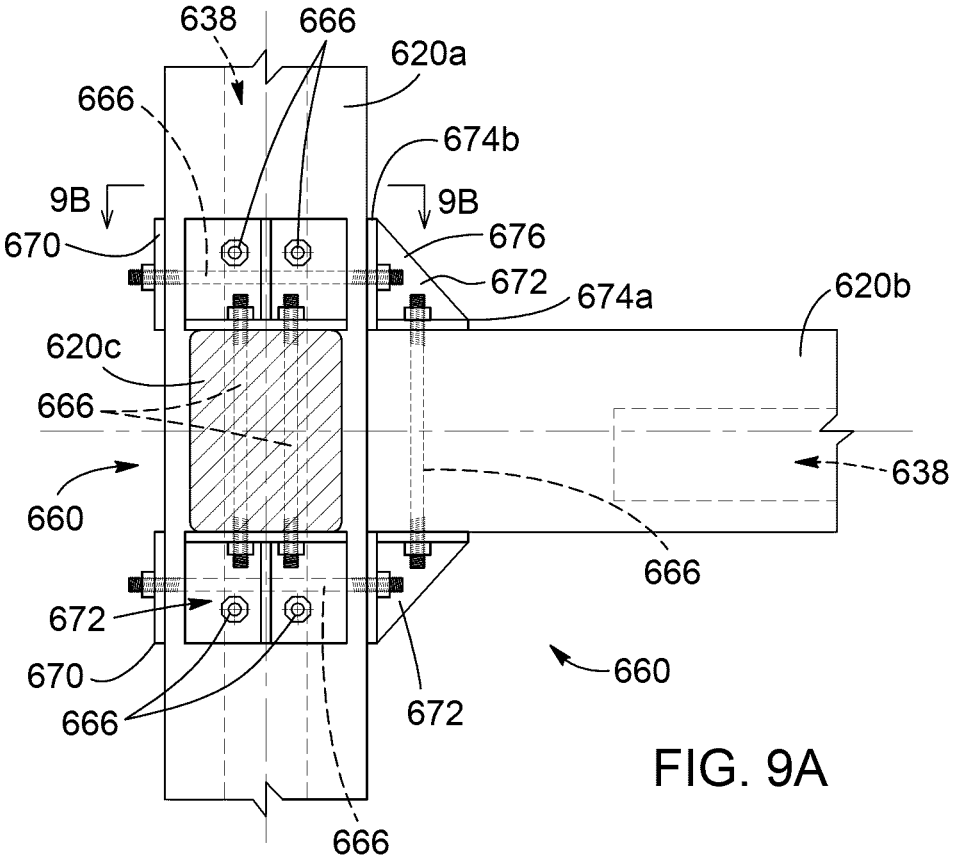
FIG. 9A is sectional view taken along section lines 9A-9A of FIG. 9B showing three composite structural members connected together in accordance with a first three-connected-member implementation, wherein the composite structural members are connected together through a combination of corner braces including structural member abutting plates, structural member abutting plates, and inwardly extending anchors.
Figure 9B:
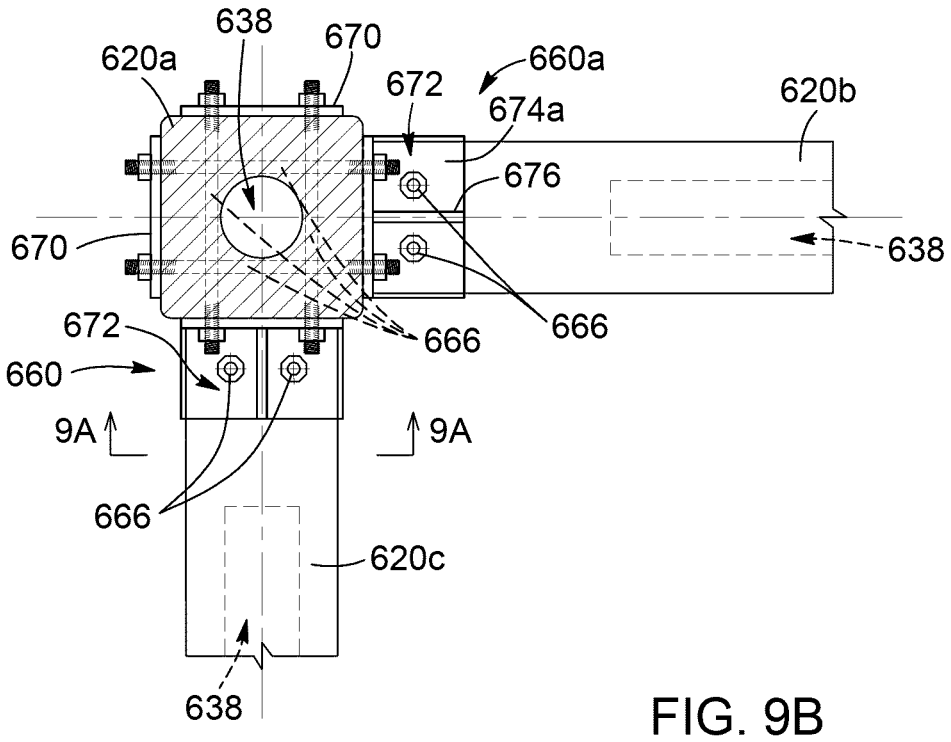
FIG. 9B is sectional view taken along section lines 9B-9B of FIG. 9A.

Referring now to FIG. 9, there is shown an implementation of a connection between three mutually perpendicular structural composite members 620*a*, 620*b*, 620*c*, i.e. one column 620*a* and two beams 620*b*, 620*c*, wherein the features are numbered with reference numerals in the 600 series which correspond to the reference numerals of the previous implementations. As shown, structural composite members 620*b*, 620*c* extend in different relative directions from the same lateral position along the structural composite member 620*a*, i.e. the column.

Each of the structural composite members 620*b*, 620*c* is connected to the structural composite member 620*a* through a connector assembly 660. Each connector assembly 660 comprises two corner braces 672, two structural member abutting plates 670, and four straight anchors 666. The corner braces 672 are mounted on two opposed sides of each respective structural composite member 620*b*, 620*c*. Each one of the corner braces 672 is substantially "L"-shaped and has a first structural member abutting plate 674*a* and a second structural member abutting plate 674*b*, extending substantially perpendicularly to the first plate 674*a*, and a reinforcing web 676 extending between and connecting the first and second structural member abutting plates 674*a*, 674*b*. The shape of the corner braces 672 can vary from the implementation shown. The first structural member abutting plate 674*a* abuts a corresponding one of the structural composite members 620*b*, 620*c* and a second structural member abutting plate 674*b* abuts the structural composite member 620*a*. The structural member abutting plates 670 are abutted against the structural composite member 620*a*, on the face opposed to the face abutted by the corresponding one of the corner brace 672, and aligned with the corner brace 672. Straight anchors 666 extend in the structural composite member 620*a* and in apertures defined in the corner brace 672 and the aligned one of the structural member abutting plates 670. Two anchors 666 are associated with each one of the second plates 674*b* of the corner braces 672 and the corresponding one of the structural member abutting plates 670, each of the anchors 666 being mounted on a respective side of the web 676. The additional anchors 666 of each connector assembly 660 extend through the respective one of the structural composite members 620*b*, 620*c*, passing through apertures defined in the first structural member abutting plates 674*a* of the opposing corner braces. End portions of the anchors 666 extend outwardly past the corner braces 672 and structural member abutting plates 670, and are secured thereto by a retaining element. In the implementation shown, the end portions of the anchors are threaded and retaining elements, such as nuts, are used to secure the anchors 666 to the structural member abutting plates 674 and the structural member abutting plates of the corner braces 672.

The anchors 666 can be engaged with the exterior shell members before pouring concrete in the inter-shell spacing. When concrete is poured in the inter-shell spacing, the anchors 666 are embedded therewith. Alternatively, molding elements can be inserted between the exterior and interior shell members before pouring concrete therein to define hollow channels in the composite structural members 620*a*, 620*b*. Straight anchors 666 can be subsequently inserted in the hollow channels to connect two composite structural members 620*a*, 620*b* together.

Straight anchors 666 extend substantially normal to the longitudinal axis of the structural composite members 620*a*, 620*b*, 620*c*. For beams 620*b*, 620*c*, the anchors 666 extend in the interior end spacings filled with concrete, i.e. between an exterior shell member and the adjacent end of the interior shell member. Sections of the reinforced concrete armature can also extend in the interior end spacings, as described above. For column 620*b*, a section of the anchors 666 extend partially through the elongated inner channel 638, perpendicularly thereto.

Figure 10A:
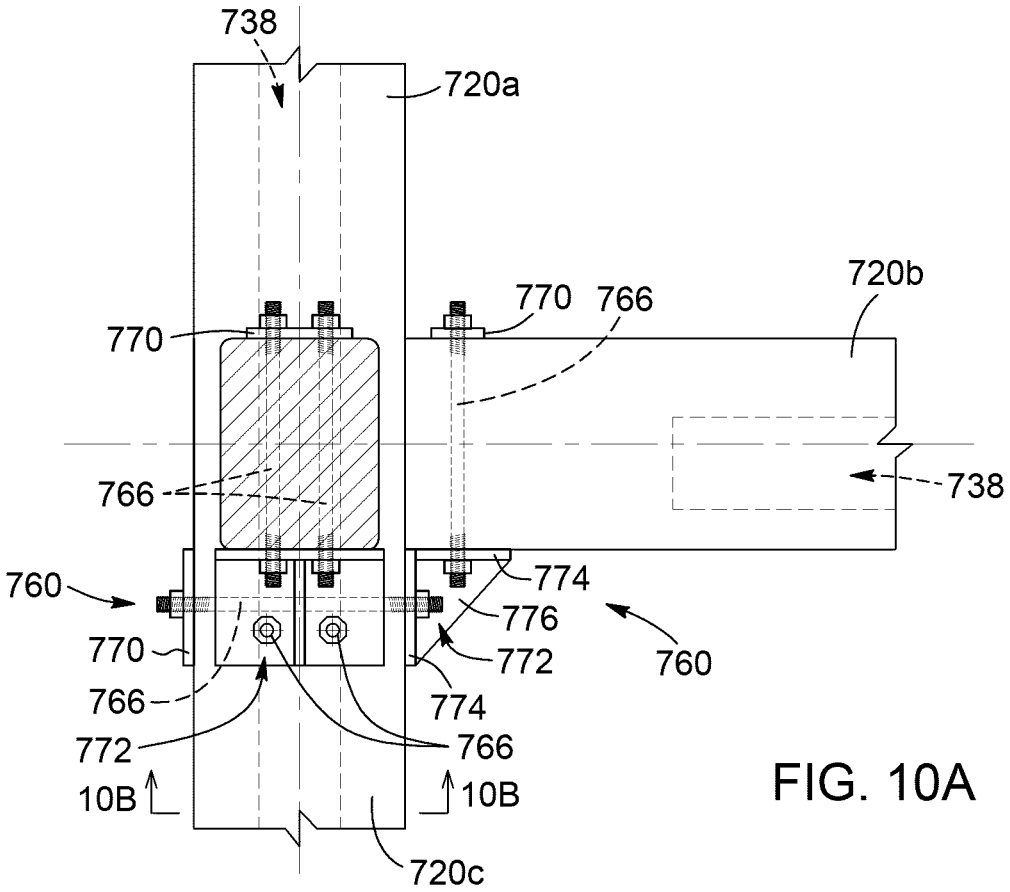
FIG. 10A is sectional view taken along section lines 10A-10A of FIG. 10B showing three composite structural members connected together in accordance with a second three-connected-member implementation, wherein the composite structural members are connected together through a different combination of corner braces including structural member abutting plates, structural member abutting plates, and inwardly extending anchors.
Figure 10B:
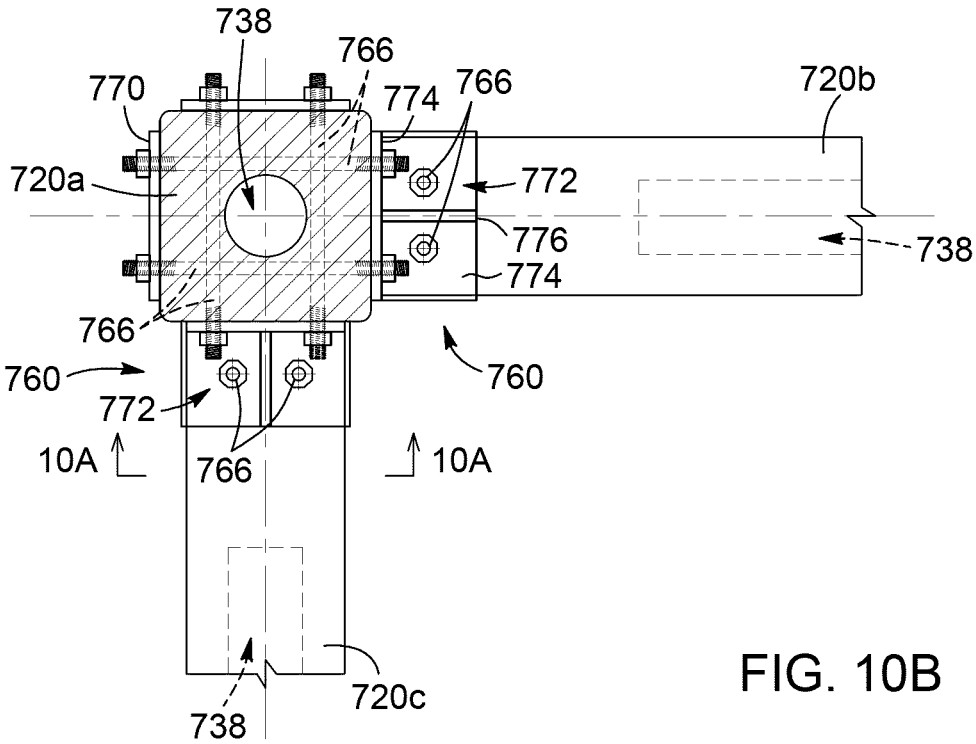
FIG. 10B is sectional view taken along section lines 10B-10B of FIG. 10A.

Referring now to FIG. 10, there is shown an alternative implementation of a connection between three mutually perpendicular structural composite members 720*a*, 720*b*, 720*c*, one column 720*a* and two beams 720*b*, 720*c*, connected through two connector assemblies 760, one for each one of the structural composite members 720*b*, 720*c*. The features are numbered with reference numerals in the 700 series which correspond to the reference numerals of the previous implementations. The connector assembly 760 is similar to the connector assembly 660 described above. However, one of the corner braces 772 of each one of the connector assemblies 760 is replaced with a structural member abutting plate 770. Thus, each connector assembly 760 includes one corner brace 772, two structural member abutting plates 770, and four anchors 766. Each one of the anchors 766 extends through one of the plates of its corresponding corner brace 772, through the corresponding composite structural member, and through the opposing structural member abutting plate 770. As in previous implementations, opposing end portions of each anchor 766 pass through the respective plates and corner braces and are secured there with retaining elements. In the implementation shown, the end portions are threaded to receive retaining elements, such as nuts, that secure the components together.

Figure 11A:
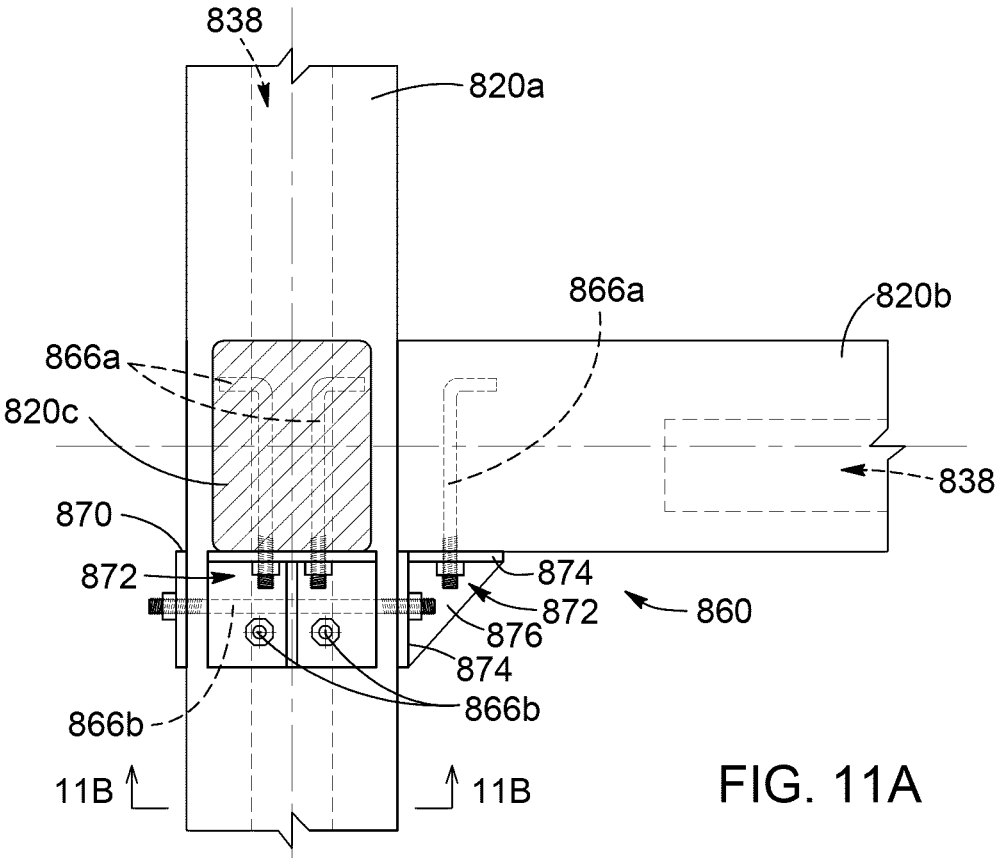
FIG. 11A is sectional view taken along section lines 11A-11A of FIG. 11B showing three composite structural members connected together in accordance with a third three-connected-member implementation, wherein the composite structural members are connected together through a combination of corner braces including structural member abutting plates, structural member abutting plates, and inwardly extending anchors.
Figure 11B:
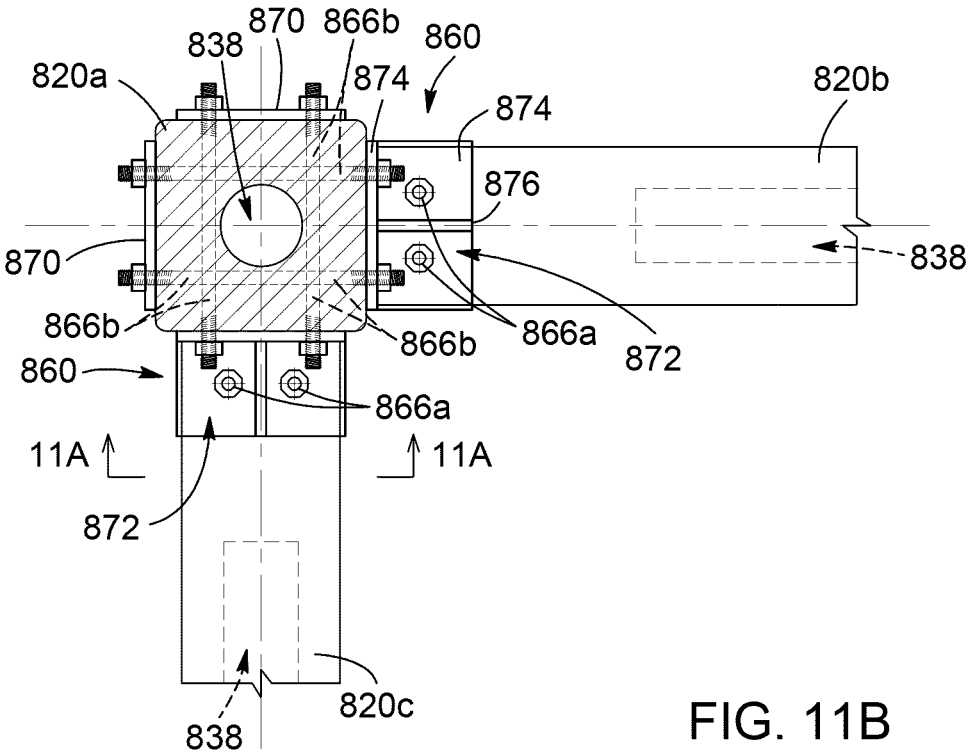
FIG. 11B is sectional view taken along section lines 11B-11B of FIG. 11A.

For the implementations of FIGS. 10 and 11, the anchors 666, 766 can be engaged with the exterior shell members before pouring concrete in the inter-shell spacing. When concrete is poured in the inter-shell spacing, the anchors 666, 766 are embedded therewith. Alternatively, molding elements can be inserted between the exterior and interior shell members before pouring concrete therein to define hollow channels in the composite structural members 620*a*, 620*b*, 620*c*, 720*a*, 720*b*, 720*c*. Straight anchors 666, 766 can be subsequently inserted in the hollow channels to connect two composite structural members 620*a*, 620*b*, 620*c*, 720*a*, 720*b*, 720*c* together.

Straight anchors 666, 766 extend substantially normal to the longitudinal axis of the structural composite members 620*a*, 620*b*, 620*c*, 720*a*, 720*b*, 720*c*. For beams 620*b*, 620*c*, 720*b*, 720*c*, the anchors 666, 766 extend in the interior end spacings filled with concrete, i.e. between an exterior shell member and the adjacent end of the interior shell member. Sections of the reinforced concrete armature can also extend in the interior end spacings, as described above. For column 620*a*, 720*a*, a section of the anchors 666, 766 extend partially through the elongated inner channel 638, 738, perpendicularly thereto.

Referring now to FIG. 11, there is shown an alternative implementation of a connection between three mutually perpendicular structural composite members 820*a*, 820*b*, 820*c*, one column 820*a* and two beams 820*b*, 820*c*, connected through two connector assemblies 860, one for each of the structural composite members 820*b* and 820*c*, i.e. the beams. The features are numbered with reference numerals in the 800 series which correspond to the reference numerals of the previous implementations.

The connector assemblies 860 are similar to the connector assemblies 760 described above, except that each connector assembly includes two sets of anchors 866*a*, 866*b*. However, instead of using anchors that all pass completely through one of the structural composite members, some of the anchors 866*a* of the present implementation are substantially "L"-shaped anchors that have a section that is embedded in the interior end spacings of the beams 820*b*, 820*c*, filled with concrete. An end section of the anchors 866*a* extends beyond the surface of the structural composite member, and passes through an aperture of one of the structural member abutting plates 874 of the corner braces 872. The "L"-shaped anchors 866*a* of each beam 820*b* and 820*c* have threading on the exterior portion, by which retaining elements, such as nuts, may be used to secure them to their respective corner braces 872. The other structural member abutting plates 874 of the corner braces 872 are secured to the column 820*a* by straight anchors 866*b* that pass completely through the column 820*a* and are secured to respective structural member abutting plates 870 on the opposite side. In the implementation shown, the two ends of these anchors 866*b* are threaded and retaining elements, such as nuts, are used to secure them at both sides.

As for the above described implementations, the "L"-shaped anchors 866*a* are inserted in the interior end spacings before pouring concrete therein. Straight anchors 866*b* can be either engaged with the shell(s) before pouring concrete therebetween or inserted in hollow channels defined in concrete.

Figure 12A:
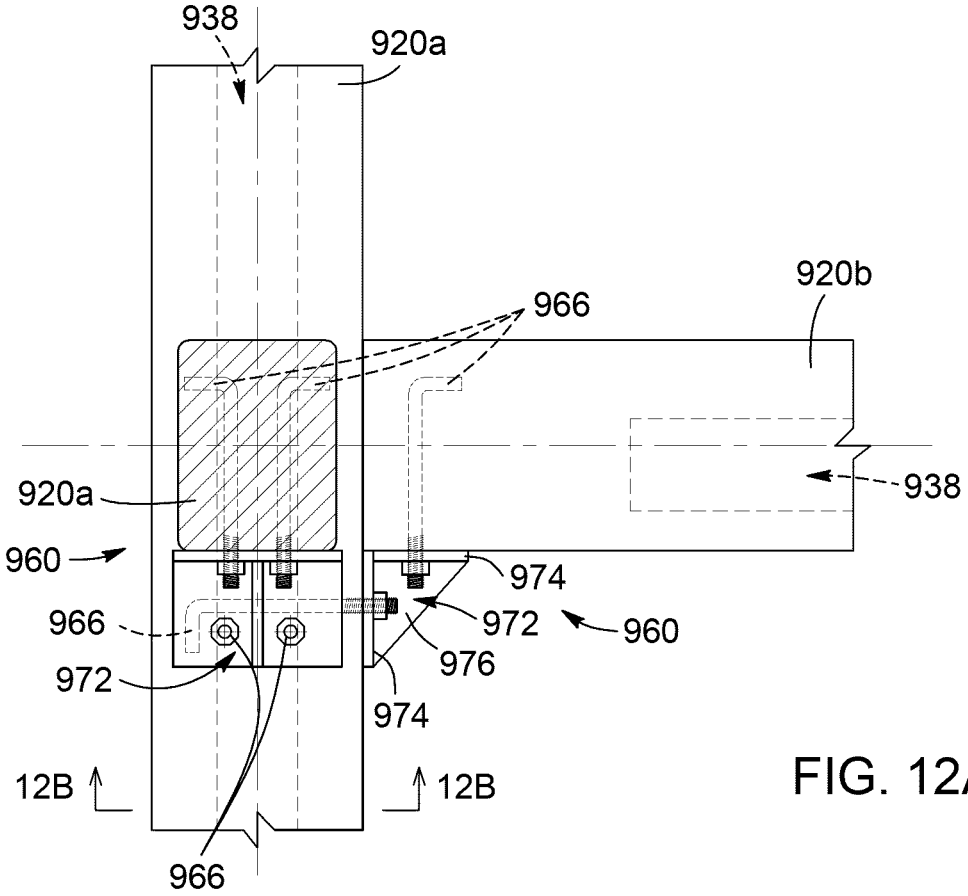
FIG. 12A is sectional view taken along section lines 12A-12A of FIG. 12B showing three composite structural members connected together in accordance with a fourth three-connected-member implementation, wherein the composite structural members are connected together through a different combination of corner braces including structural member abutting plates and inwardly extending anchors.
Figure 12B:
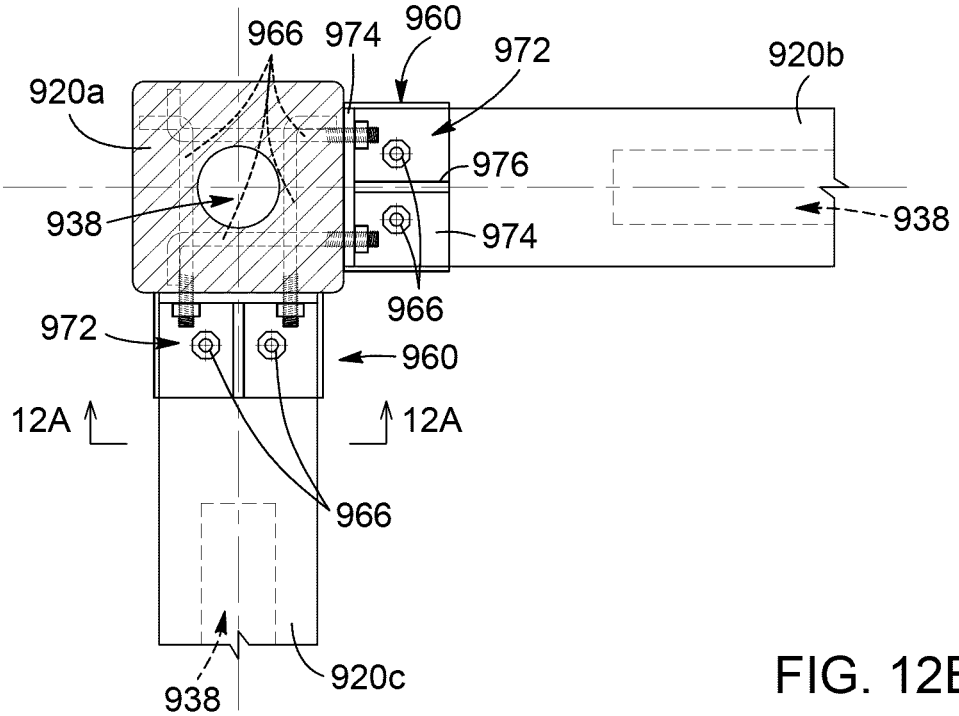
FIG. 12B is sectional view taken along section lines 12B-12B of FIG. 12A.

Referring now to FIG. 12, there is shown another implementation of a connection between three mutually perpendicular structural composite members 920*a*, 920*b*, 920*c*, one column 920*a* and two beams 920*b*, connected by two connector assemblies 960, one for each one of the structural composite members 920*b*, 920*c*. The features are numbered with reference numerals in the 900 series which correspond to the reference numerals of the previous implementations.

The connector assemblies 960 are similar to the connector assemblies 860 described above. However, the anchors 966 inserted in all three structural composite members 920*a*, 920*b*, 920*c* are "L"-shaped anchors, like those shown in FIG. 11. Thus, each connector assembly 960 includes one corner brace 972, and four "L"-shaped anchors, each of which has one end embedded in its respective structural composite member, and the other extending from the surface of the structural composite member and through an aperture of a structural member abutting plate of a corresponding corner brace 972. Thus, in comparison with the connection described above in reference to FIG. 11, all the combinations of straight anchors and structural member abutting plates are replaced with "L"-shaped anchors 966. As in previous implementations, the exterior end of the anchors 966 may be threaded and secured to the corner braces with retaining elements, such as nuts.

Figure 13A:
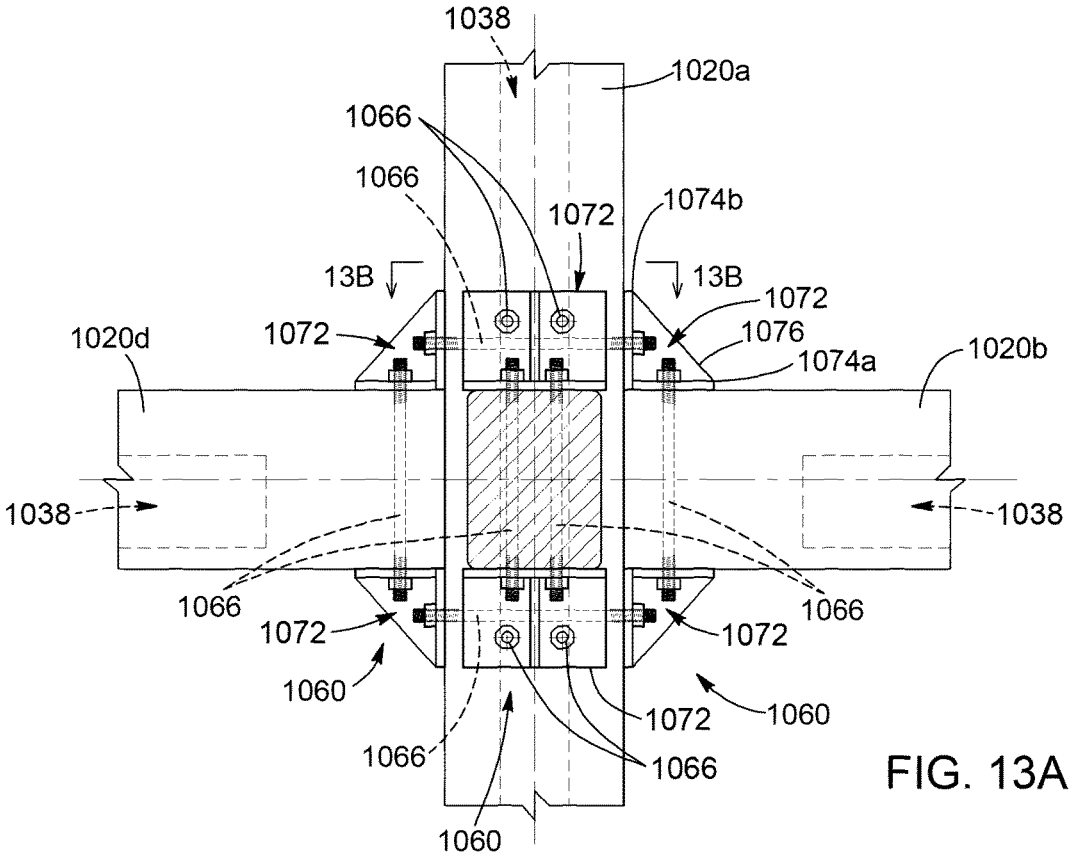
FIG. 13A is sectional view taken along section lines 13A-13A of FIG. 13B showing four composite structural members, connected together in accordance with a first four-connected-member implementation, wherein the composite structural members are connected together through corner braces including structural member abutting plates and inwardly extending anchors.
Figure 13B:
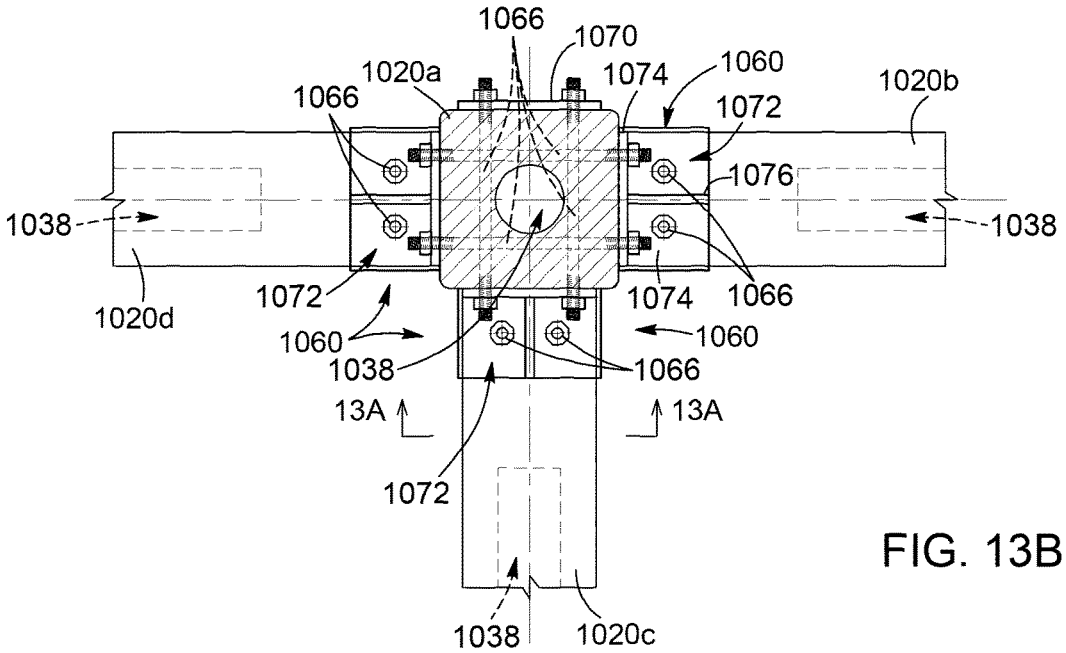
FIG. 13B is sectional view taken along section lines 13B-13B of FIG. 13A.

Referring now to FIG. 13, there is shown an implementation of a connection between four structural composite members 1020*a*, 1020*b*, 1020*c*, 1020*d*, i.e one column 1020*a* and three beams 1020*b*, 1020*c*, 1020*d* with beams 1020*b*, 1020*d* being aligned. Each one of the structural composite members 1020*b*, 1020*c*, 1020*d* is connected, and extends perpendicularly, to the structural composite member 1020*a* through a connector assembly 1060. The features are numbered with reference numerals in the 1000 series which correspond to the reference numerals of the previous implementations.

The structural composite members 1020*b*, 1020*c*, 1020*d*, i.e. the beams, extend at the same longitudinal position along the structural composite member 1020*a*, i.e. the column, and perpendicularly thereto.

The connector assemblies 1060 are similar to the connector assemblies 660 described above in reference to FIG. 9 in that the anchors 1066 used are straight anchors that extend completely through the column 1020*a*. Where beams connect to opposite sides of the column 1020*a*, as in the case of beams 1020*b* and 1020*d*, the anchors 1066 are connected at each side by corner braces 1072 that are, in turn, connected to their respective beams. For a beam that has no opposing beam, as in the case of beam 1020*c*, a structural member abutting plate 1070 is used on the opposite side. In the implementation shown, the corner braces 1072 are located on two different sides of each beam, such that each beam is connected to the column 1020*c* by four straight anchors 1066, the anchors of beams 1020*b* and 1020*d* being shared between them. As in previous implementations, the anchors 1066 may be threaded at their ends and secured with retaining elements, such as nuts, on the side of the corner brace 1076 or structural member abutting plate 1070 opposite the structural composite member 1020*a* in question.

Figure 14A:
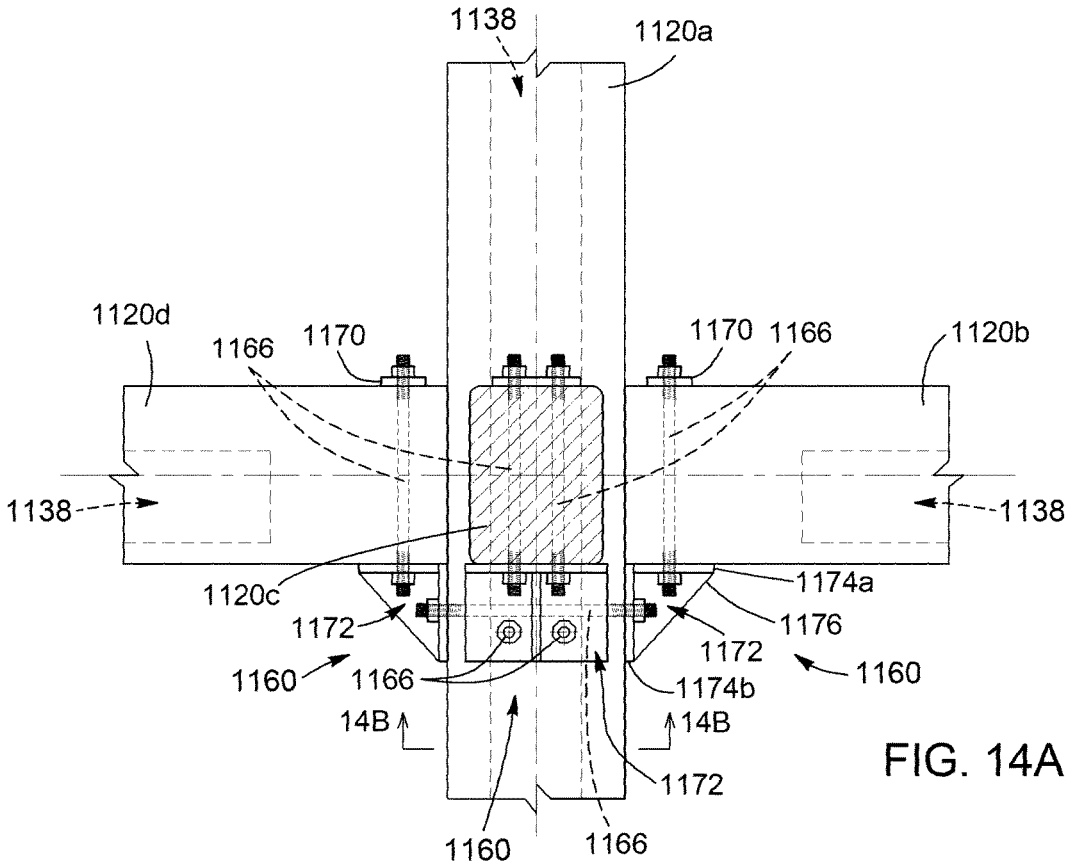
FIG. 14A is sectional view taken along section lines 14A-14A of FIG. 14B showing four composite structural members, connected together in accordance with a second four-connected-member implementation, wherein the composite structural members are connected together through a combination of corner braces including structural member abutting plates, structural member abutting plates, and inwardly extending anchors.
Figure 14B:
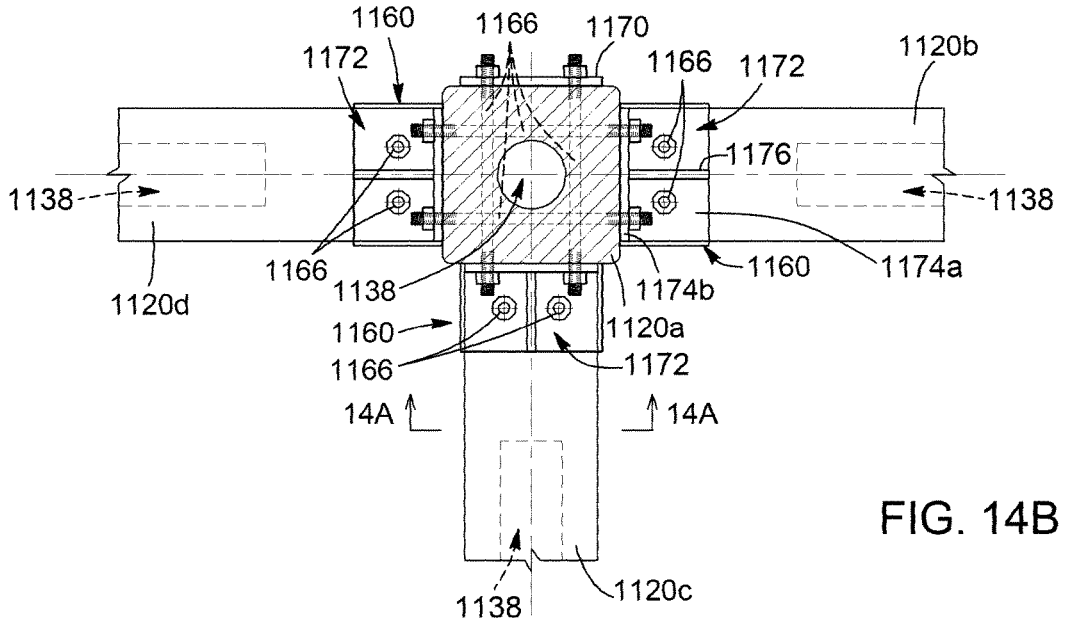
FIG. 14B is sectional view taken along section lines 14B-14B of FIG. 14A.

Referring now to FIG. 14, there is shown an alternative implementation of a connection between four structural composite members 1120*a*, 1120*b*, 1120*c*, 1120*d*, i.e. one column 1120*a* and three beams 1120*b*, 1120*c*, 1120*d* with beams 1120*b*, 1120*d* being aligned, connected through three connector assemblies 1160, one for each one of the composite members 1120*b*, 1120*c*, 1120*d*. The features are numbered with reference numerals in the 1100 series which correspond to the reference numerals of the previous implementations.

The connector assemblies 1160 are similar to the connector assemblies 760, 1060 described above in reference to FIGS. 10 and 13 respectively. However, instead of using corner braces 1172 on opposite sides of each beam 1120*b*, 1120*c*, 1120*d*, only one corner brace 1172 is used for each beam 1120*b*, 1120*c*, 1120*d*, with a structural member abutting plate 1170 being used on the opposite side. Thus, in this implementation, each beam 1120*b*, 1120*c*, 1120*d* is connected to column 1120*a* by only two straight anchors, the anchors of beams 1120*b* and 1120*d* being shared between them.

Figure 15A:
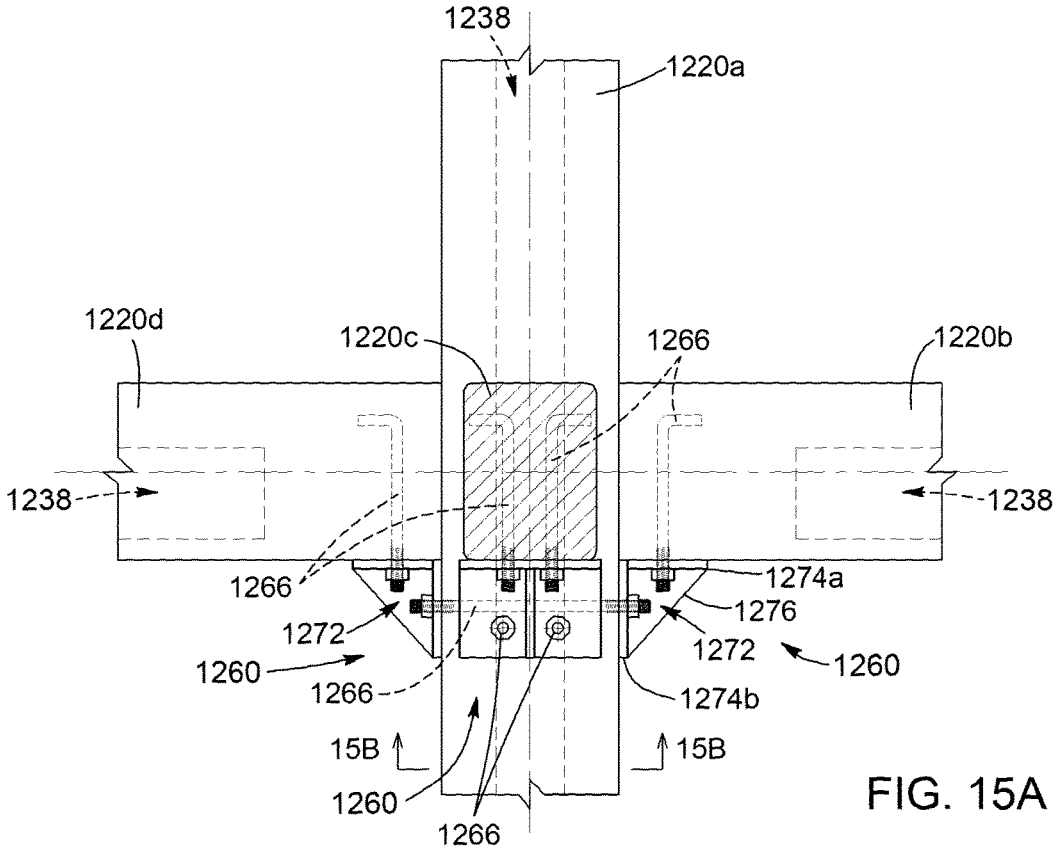
FIG. 15A is sectional view taken along section lines 15A-15A of FIG. 15B showing four composite structural members, connected together in accordance with a third four-connected-member implementation, wherein the composite structural members are connected together through a combination of corner braces including structural member abutting plates, structural member abutting plates, and inwardly extending anchors.
Figure 15B:
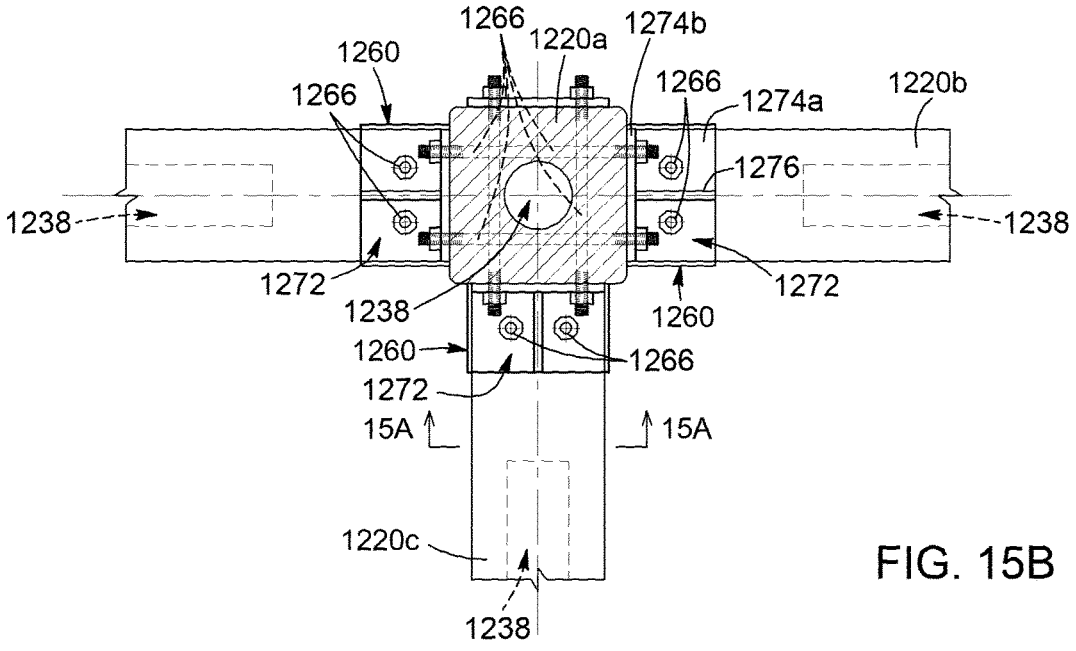
FIG. 15B is sectional view taken along section lines 15B-15B of FIG. 15A.

Referring now to FIG. 15, there is shown an alternative implementation of a connection between four structural composite members 1220*a*, 1220*b*, 1220*c*, 1220*d*, i.e. one column 1220*a* and three beams 1220*b*, 1220*c*, 1220*d* with beams 1220*b*, 1220*d* being aligned, connected through three connector assemblies 1260, one for each one of the composite members 1220*b*, 1220*c*, 1220*d*. The features are numbered with reference numerals in the 1200 series which correspond to the reference numerals of the previous implementations.

The connector assembly 1260 is similar to the connector assembly 1160 described above in reference to FIG. 14, except that the anchors 1266 inserted in the three beams 1220*b*, 1220*c*, 1220*d* are substantially "L"-shaped anchors like those described above in previous implementations, having one section embedded in the respective structural member. The outer end section of each "L"-shaped anchor 1266 extends through the surface of the corresponding structural composite member 1220*b*, 1220*c*, 1220*d* and is secured to one of the corner braces 1272, as described above in reference to FIG. 11. As in the FIG. 14 implementation, each beam 1220*b*, 1220*c* and 1220*d* is connected to the column 1220*a* by two straight anchors, two passing from the corner brace 1272 of beam 1220*b* to the corner brace of beam 1220*d* on the opposite side, while the anchors of beam 1220*c* are secured on the opposite side of the column 1220*a* by a structural member abutting plate 1270.

Figure 16A:
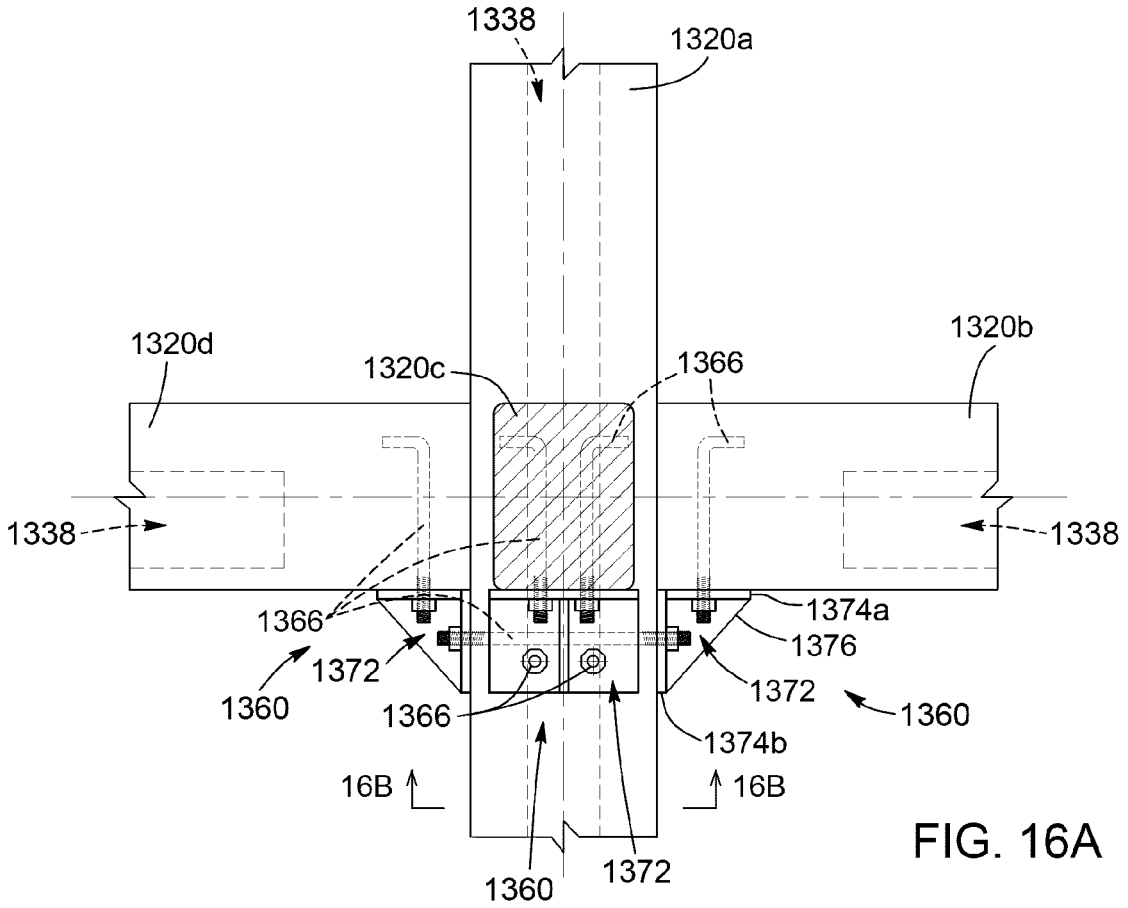
FIG. 16A is sectional view taken along section lines 16A-16A of FIG. 16B showing four composite structural members, connected together in accordance with a fourth four-connected-member implementation, wherein the composite structural members are connected together through a different combination of corner braces including structural member abutting plates and inwardly extending anchors.
Figure 16B:
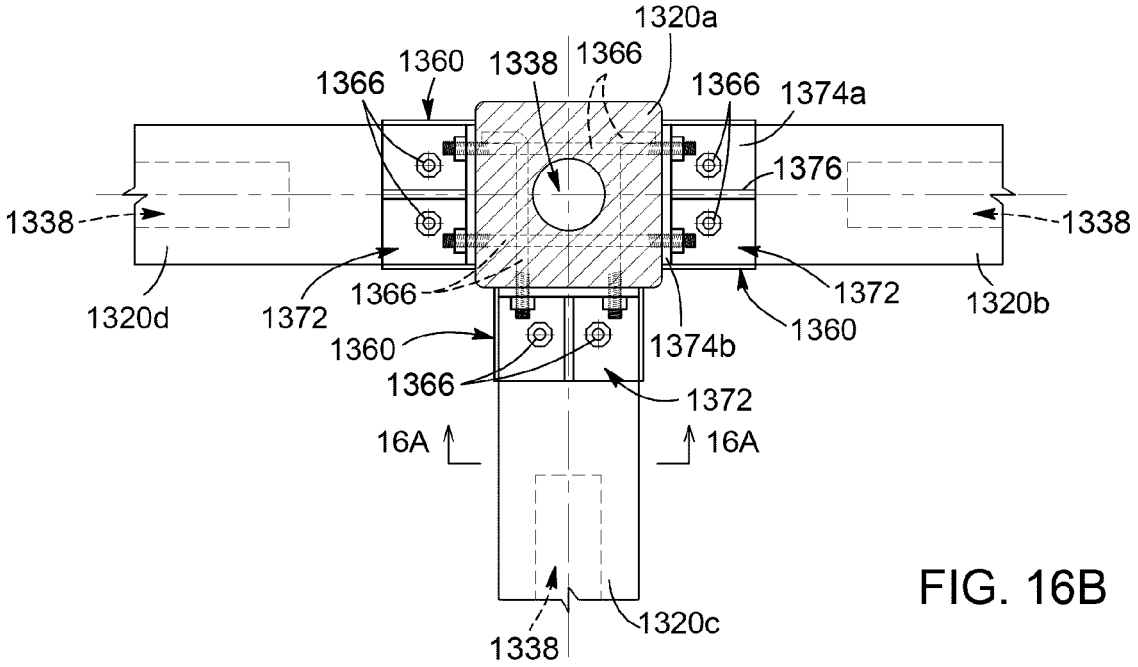
FIG. 16B is sectional view taken along section lines 16B-16B of FIG. 16A.

Referring now to FIG. 16, there is shown an alternative implementation of a connection between four structural composite members 1320*a*, 1320*b*, 1320*c*, 1320*d*, i.e. one column 1320*a* and three beams 1320*b*, 1320*c*, 1320*d* with beams 1320*b*, 1320*d* being aligned, connected through three connector assemblies 1360, one for each one of the composite members 1320*b*, 1320*c*, 1320*d*. The features are numbered with reference numerals in the 1300 series which correspond to the reference numerals of the previous implementations.

The implementation of FIG. 16 is similar to that of FIG. 15, except that the beam 1320*c* is secured to the column 1320*a* by "L"-shaped anchors rather than by straight anchors that connect to a structural member abutting plate on the opposite side of the column. Thus, each beam 1320*b*, 1320*c* and 1320*d* is connected to its corner brace by two "L"-shaped anchors, and the corner braces of beams 1320*b* and 1320*d* are connected to each other by straight anchors that pass completely through the column 1320*a*. The corner brace of beam 1320*c*, however, is connected to the column by "L"-shaped anchors.

Figures 17A, 17B:
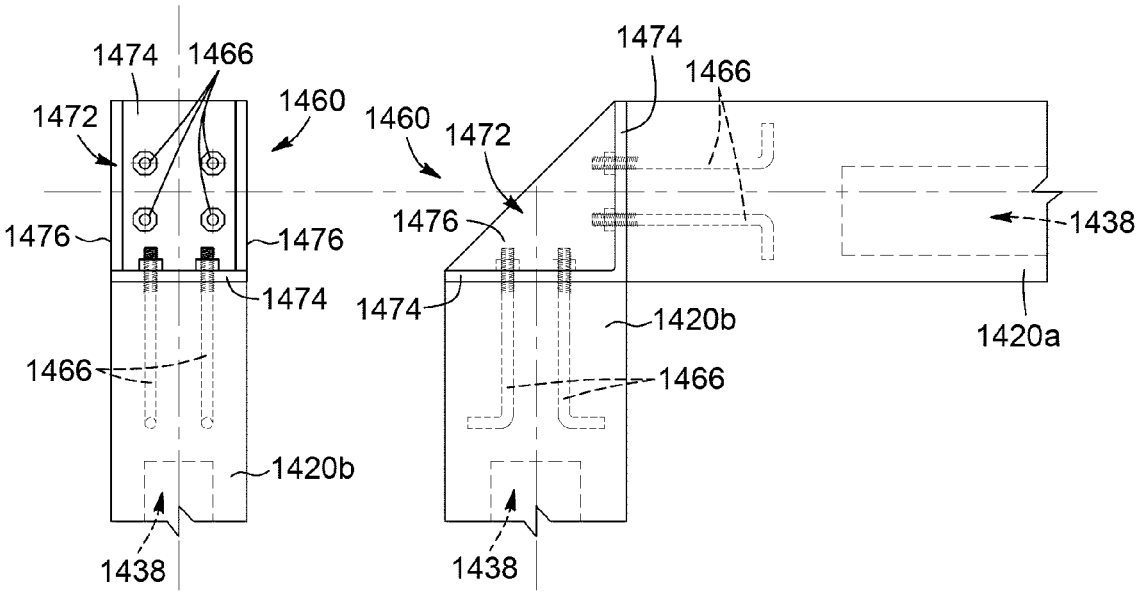
FIG. 17A is a side elevation view, fragmented, of two composite structural members connected together in accordance with a fourth two-connected-member implementation, wherein the composite structural members are connected through a combination of a structural member abutting plate and inwardly extending anchors.
FIG. 17B is a front elevation view of the two composite structural members shown in FIG. 17A.

Referring now to FIG. 17, there is shown an alternative implementation of a connection between two structural composite members 1420*a*, 1420*b*, i.e. one column 1420*b* and one beam 1420*a* through one connector assembly 1460. The features are numbered with reference numerals in the 1400 series which correspond to the reference numerals of the previous implementations.

In this implementation, the ends of the structural composite members 1420*a*, 1420*b* are mounted in an adjacent configuration through the connector assembly 1460. The connector assembly 1460 includes a corner brace 1472 with two structural member abutting plates 1474 and eight "L"-shaped anchors 1466. Each one of the structural member abutting plates 1474 abuts a respective end of the structural composite members 1420*a*, 1420*b*. The corner brace 1472 also includes two reinforcing webs 1476 extending between the structural member abutting plates 1474 and being spaced-apart from one another. The "L"-shaped anchors 1466 extend in the interior end spacings of a respective one of the structural composite member 1420*a*, 1420*b* and in apertures defined in the structural member abutting plates 1474 of the corner brace 1472, between the two reinforcing webs 1476. The anchors 1466 are inserted in the interior end spacings before pouring concrete therein.

Figure 18A:
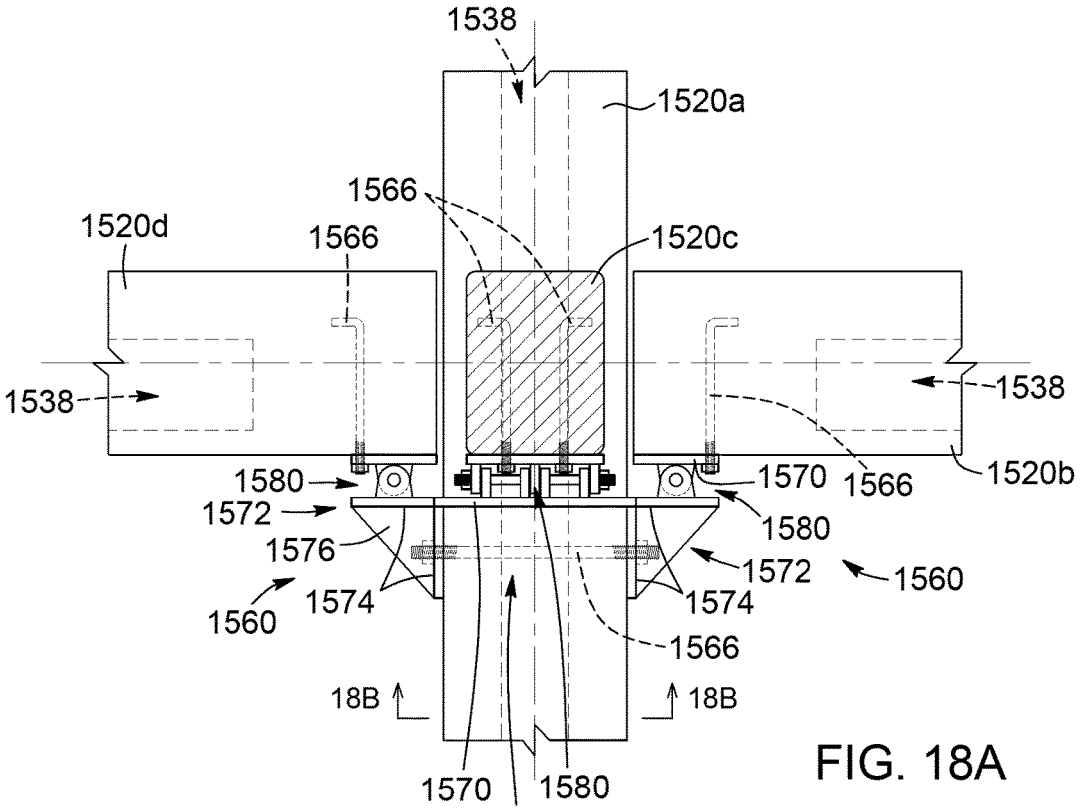
FIG. 18A is sectional view taken along section lines 18A-18A of FIG. 18B showing four composite structural members, connected together in accordance with a fifth four-connected-member implementation, wherein the composite structural members are connected together through a different combination of corner braces including structural member abutting plates, structural member abutting plates, inwardly extending anchors, and pivoting assemblies.
Figure 18B:
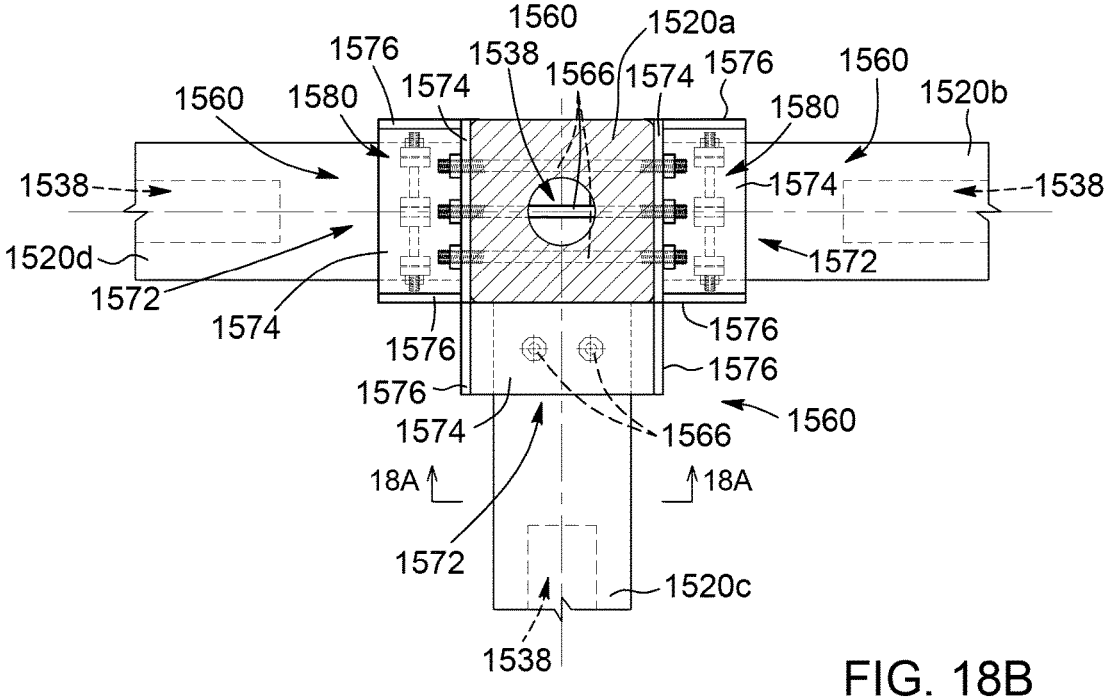
FIG. 18B is sectional view taken along section lines 18B-18B of FIG. 18A.

Referring now to FIG. 18, there is shown an alternative implementation of a connection between four structural composite members 1520*a*, 1520*b*, 1520*c*, 1520*d*, i.e. one column 1520*a* and three beams 1520*b*, 1520*c*, 1520*d* with beams 1520*b*, 1520*d* being aligned, connected through three connector assemblies 1560, one for each beam 1520*b*, 1520*c*, 1520*d* connected to column 1520*a*. The features are numbered with reference numerals in the 1500 series which correspond to the reference numerals of the previous implementations.

Each one of the beams 1520*b*, 1520*c*, 1520*d* comprise two "L"-shaped anchors 1566 embedded in concrete of the interior end spacing, normal to the longitudinal axis. An end section of each one of the "L"-shaped anchors 1566 extend outwardly of the respective beam 1520*b*, 1520*c*, 1520*d* and through an aperture defined in a structural member abutting plate 1570. The structural member abutting plate 1570 abuts an outer face of the exterior shell member, close to an end of the beam 1520*b*, 1520*c*, 1520*d*, and is secured with retaining elements mounted to the end sections of the anchors 1566.

The connector assemblies 1560 of beams 1520*b*, 1520*d* further includes a corner brace 1572, each one including two plates 1574 at end thereof and through two spaced-apart reinforcing webs 1576. One of the two plates 1574 abuts the outer surface of the exterior shell member of column 1520*a* while the other one extends under a respective one of the beams 1520*b*, 1520*d* and is spaced-apart therefrom. The plates 1574 abutting the outer surface of the exterior shell member of column 1520*a* are connected together through straight anchors 1566 extending through the column 1520*a*.

The connector assembly 1560 of beam 1520*c* includes a plate 1570 extending perpendicularly to the outer surface of the exterior shell member of column 1520*a* and connected to the other connector assemblies 1560 through two spaced-apart reinforcing webs 1576. Plate 1570 extends below beam 1520*c*.

Plate 1570 and each one of the plates 1574 is connected to a respective one the beams 1570*b*, 1570*c*, 1570*d* through a pivoting assembly 1580. Each one of the pivoting assembly 1580 has a section mounted to the structural member abutting plate 1570 abutting the respective one of the beams 1570*b*, 1570*c*, 1570*d* and another section mounted to one of plate 1570 and a respective one of the plates 1574. The two sections are connected together through a hinge pin.

It is appreciated that similar connector assemblies can be used to connect one or more beams to a column.

Figure 19A:
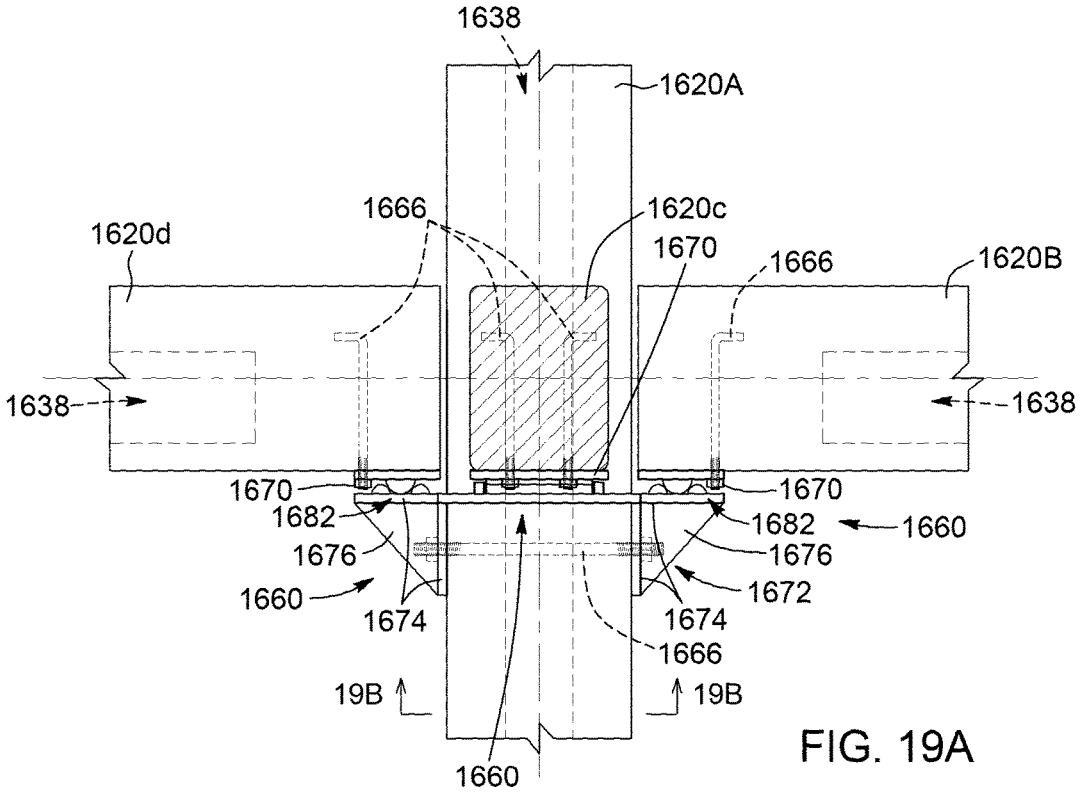
FIG. 19A is sectional view taken along section lines 19A-19A of FIG. 19B showing four composite structural members, connected together in accordance with a sixth four-connected-member implementation, wherein the composite structural members are connected together through a different combination of corner braces including structural member abutting plates, structural member abutting plates, inwardly extending anchors, and half-cylinder assemblies.
Figure 19B:
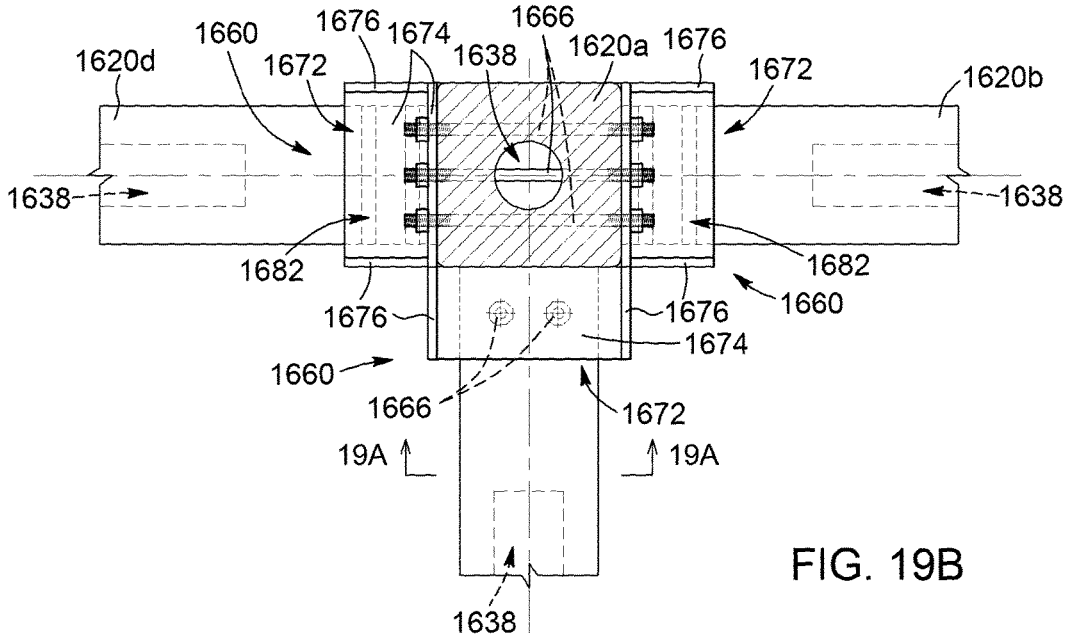
FIG. 19B is sectional view taken along section lines 19B-19B of FIG. 19A.

Referring now to FIG. 19, there is shown an alternative implementation of a connection between four structural composite members 1620*a*, 1620*b*, 1620*c*, 1620*d*, i.e. one column 1620*a* and three beams 1620*b*, 1620*c*, 1620*d* with beams 1620*b*, 1620*d* being aligned, connected through three connector assemblies 1660, one for each beam 1620*b*, 1620*c*, 1620*d* connected to column 1620*a*. The features are numbered with reference numerals in the 1600 series which correspond to the reference numerals of the previous implementations.

The implementation of FIG. 19 is similar to that of FIG. 18, except that the pivoting assemblies 1580 are replaced with a half-cylinder assembly 1682 extending between structural member abutting plate 1670 and one of plate 1670 and a respective one of the plates 1674. Each half-cylinder assembly 1682 includes two half cylinders mounted to one of plate 1670 and a respective one of the plates 1674 and spaced-apart from one another and one half cylinder mounted to a respective one of structural member abutting plates 1670. The half cylinder mounted to a respective one of structural member abutting plates 1670 is received between and secured to the two half cylinders mounted to one of plate 1670 and a respective one of the plates 1674.

As for the implementations described above, it is appreciated that similar connector assemblies can be used to connect one or more beams to a column.

For all implementations described above and combination thereof, for anchors being "L"-shaped anchors, the anchors are engaged with the outer shell member of the corresponding structural composite member before pouring concrete the inter-shell spacing. Thus, the "L"-shaped anchors are at least partially embedded in concrete.

The columns of the above described embodiments can include a wider section along their length aligned with the perpendicularly extending beam(s). The anchors of the connectors can extend through the wider section, thereby enhancing the bond between the anchors and the column concrete.

It will be appreciated by those skilled in the art that a connexion described in reference to two adjoining structural composite members can be used to connect three or more structural composite members. It will also be appreciated that a connexion described in reference to three or four adjoining structural composite members can be used to connect more or fewer structural composite members together. Combinations of the above-described connexions can be used to connect two or more composite structural members together.

An embodiment of a process to manufacture the composite structural member will now be described.

The desired mechanical properties of the composite structural member, either a beam or a column, are first determined. Then, the materials are selected for the interior and exterior shell members as well as the concrete and the reinforcement bar(s). The composite structural member can be designed by simulation, for instance with a Finite Element Method (FEM). It is thus possible to determine the size of the cross-section, the thickness of the interior and exterior shell members, the number and the configuration of the reinforcement bar(s), the length of the interior shell member, and the like. If the interior shell member or the exterior shell member is made of fiber reinforced polymer (FRP), the number of composite layers and the orientation of the fibers can be determined.

Once the composite structural member is designed, the interior and exterior shell members and the reinforcement bar(s) are manufactured. If the interior shell member or the exterior shell member is made of FRP, different manufacturing processes can be used, such as filament winding, pultrusion and injection. Different fibers/resins combinations can be used to build FRP shell members including, but not limited to, glass fibers, aramid fibers, carbon fibers, basalt fibers, and vinyl ester resins, epoxy resins, polyester resins. Additives can be used in the resin mixture to protect the exterior shell member from UV degradation.

Concrete adherence improvement treatments, as described above, can be applied to one of the outer surface of the interior shell member and the inner surface of the exterior shell member.

The interior shell member is inserted in the exterior shell member and positioned longitudinally and radially therein. The reinforcement bar(s) is (are) then inserted in the inter-shell spacing and positioned longitudinally and radially therein. Plastic chairs (or spacers) are used to support the reinforced concrete armature in the inter-shell spacing. If required by the design of the composite structural member, sections of the reinforcement bar(s) can be bent. The ends of the interior shell member are then closed at an inside given length to ensure that the inner channel remains substantially empty for a specified length when concrete is poured in the inter-shell spacing. Also, when required, any anchors that are part of a connector assembly are inserted and positioned. Finally, concrete is poured in the inter-shell spacing in a conventional manner. This can be followed by additional steps, such as waiting for the curing of the concrete, testing the quality control of the composite structural member, and the like.

EXAMPLES

Three types of beams were tested under pure bending: a conventional reinforced concrete (RC) beam, a fully concrete-filled fiber reinforced polymer (FRP) shell member (CFFT) beam, and a partially CFFT beam. The test included two identical partially CFFT beams. These beams have been tested up to failure. All the beams had the same cross sectional area and span, and were cast using the same concrete batch. Fabrication of the shell members, materials used, beam specimens details, and test setup and installments are detailed below.

Fabrication of FRP Shell Members

Two different sizes of FRP shell members were fabricated for the example. The exterior shell member had a rectangular cross section of 305×406 mm with rounded corners having a 25 mm radius to avoid damage due to stress concentration. The interior shell member had a circular cross section with a 218 mm diameter. E-glass fibers and vinyl ester resin were used to fabricate the shell members. The shell members were fabricated by a filament-winding process in the civil engineering department at Sherbrooke University in Sherbrooke, Quebec. Only two winding patterns were used; a helical pattern with an orientation angle of 30° and a circumferential pattern with an angle of 90°. The helical pattern (30°) was used mainly to present the longitudinal reinforcement and was used to designate the exterior shell members, while the circumferential pattern (90°) was used to provide shear reinforcement and to prevent buckling of the longitudinal fibers. The identification of the interior shell members depends only on the helical pattern angle and the number of layers. All exterior shell members with a rectangular cross section had a laminate structure of [90°, ±30°, ±30°, 90°, ±30°, ±30°, 90° ] (=8 layers 30°+3 layers 90°), the identification is $O8_{30}$. All interior shell members had a circular cross section laminate structure of [90°, ±30°, ±30°, 90° ] (=4 layers 30°+2 layers 90°), the identification is $I4_{30}$.

After completion of the filament winding process, the exterior and interior shell members were heated for 24 hours at 60° C. to be cured. After pulling the mandrel out of the cured shell members and cleaning them, the surfaces intended to be adjacent to concrete were sand coated by a layer of epoxy resin and coarse sand to produce a rough texture in order to enhance the bond between concrete and the exterior and interior shell members. Then, the exterior and interior shell members were cut to the required length of beam specimens.

Mechanical Performance of the GFRP (Glass Fiber Reinforced Polymer) Structural Members For all exterior and interior shell members, the tensile strength in the longitudinal and lateral direction was measured. For the rectangular exterior shell members, six identical coupons in the longitudinal direction and another six coupons were tested under tension following ASTM D 3039/D 3039M (ASTM D 3039/D 3039M, Standard test method for tensile properties of polymer matrix composite materials, American Society for Testing of Materials, West Conshohocken, Pa., USA, (2000)). The test was carried out on the interior shell members in the longitudinal direction, while the split disk test was used to measure the tensile strength in the hoop direction according to ASTM D 2290 (ASTM D 2290, Apparent Hoop Tensile Strength of Plastic or Reinforced Plastic Pipe by Split Disk Method, American Society for Testing of Materials, West Conshohocken, Pa., USA (2008)). For each coupon, the average width and thickness of the central part was measured to get the effective sectional area to calculate the effective stress. The tests were performed using MTS press 810. An extensometer was placed on the specimen in order to measure strain. A data acquisition system connected to the machine recorded the loads, axial displacement, and axial strain. Table 1 lists the configurations and mechanical properties of the shell members.

TABLE 1

GFRP shell member configurations and mechanical properties

| Shell member | Cross Section (mm) | Stacking sequence | ID | $t_{frp}$ (mm) | $E_x$ (GPa) | $F_x$ (MPa) | $E_y$ (GPa) | $F_y$ (MPa) |
|---|---|---|---|---|---|---|---|---|
| Exterior | Rec. 305*406 | [90°, ±30°, ±30°, 90°, ±30°, ±30°, 90°] | $O8_{30}$ | 8.5 | 24.3 | 185 | 18.1 | 142 |
| Interior | Cir. Ø = 218 | [90°, ±30°, ±30°, 90°] | $I4_{30}$ | 3.3 | 23.6 | 192 | NA | NA |

$E_x$ and $E_y$ are Young modulus in the longitudinal and lateral direction respectively.

$F_x$, and $F_y$ are the ultimate tensile strength in the longitudinal and lateral direction respectively.

$t_{frp}$: Thickness of the fiber reinforced polymer shell member

Steel Reinforcement (S)

Two different steel bar sizes were used to reinforce beam specimens; deformed steel bars 10M and 15M, i.e. diameters of 10 mm and 15 mm respectively. The mechanical properties of the steel bars were obtained from standard tests that were carried out according to ASTM A615/A615M (ASTM A615/A615M, Standard specification for deformed and plain carbon steel bars for concrete reinforcement, West Conshohocken, Pa., USA, (2009)), on five specimens for each type of the steel bars. The mechanical properties of the steel bars are listed in Table 2.

TABLE 2

Properties of reinforcing steel bars

| Φ | Size | Type | Nominal diameter (mm) | Nominal area ($mm^2$) | $F_y$ (MPa) | $F_u$ (MPa) | E (GPa) |
|---|---|---|---|---|---|---|---|
| 10 | 10 M | Deformed | 11.3 | 100 | 460 | 575 | 200 |
| 15 | 15 M | Deformed | 16 | 200 | 416 | 686 | 200 |

Beam Specimens

Figure 20C:
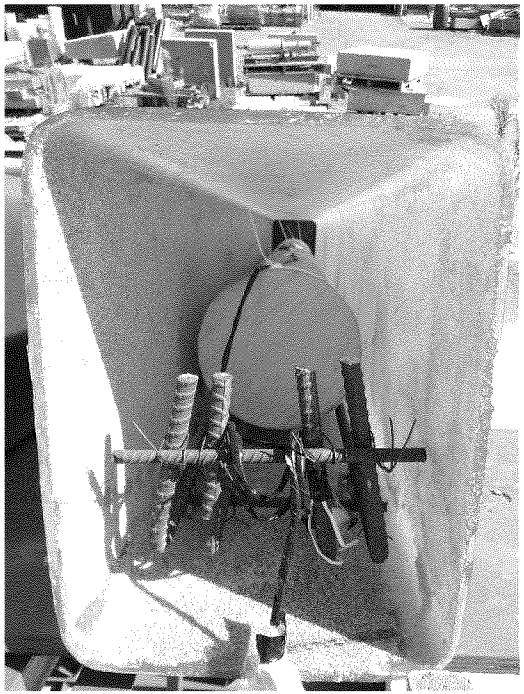
FIG. 20C is a photograph showing the reinforced concrete armature of a $O8_{30}$-$I4_{30}$-S.
Figure 20B:
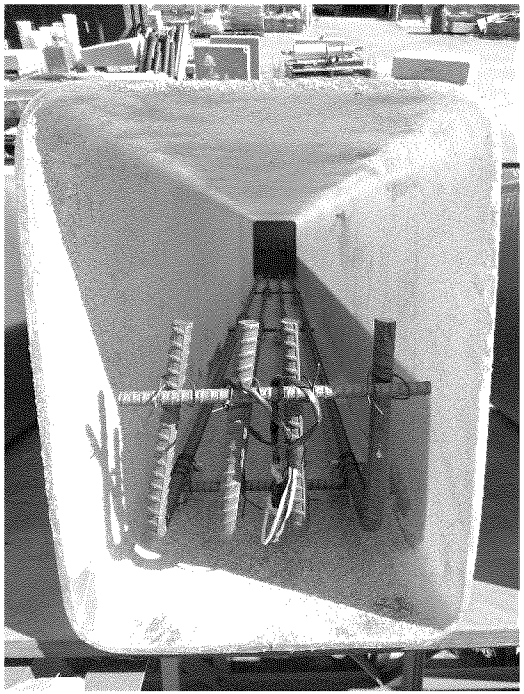
FIG. 20B is a photograph showing the reinforced concrete armature of a $O8_{30}$-S beam.
Figure 20A:
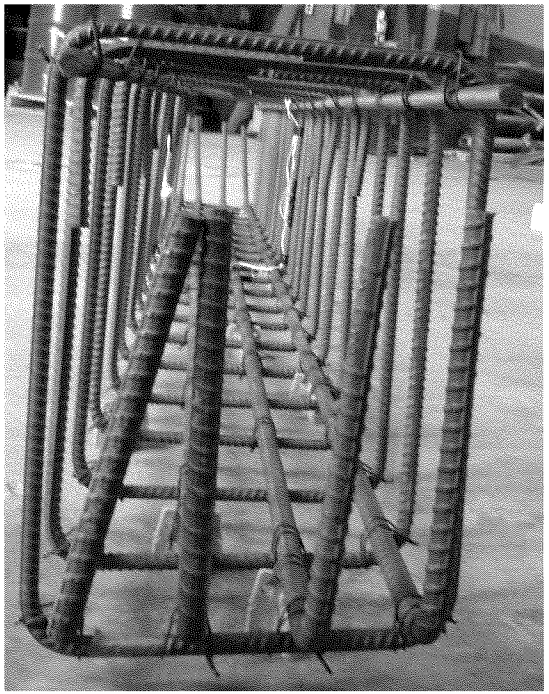
FIG. 20A is a photograph showing a reinforced concrete armature of a reinforced-concrete (RC) beam.

A total of four beam specimens, each 3.2 m in length, were used: one conventional steel-RC beam, one fully CFFT beam, and two identical partially CFFT beams were tested under flexure. The conventional RC beam was reinforced with 4ϕ15 bottom reinforcement, 2ϕ10 as a top reinforcement, and stirrups ϕ10@150 mm as shear reinforcement. The rectangular CFFT beam was completely filled with concrete and reinforced only with 4ϕ15 bottom reinforcement ($O8_{30}$-S, wherein the "S" stands for the steel bars used as reinforcement bars). The two partially CFFT beams ($O8_{30}$-$I4_{30}$-S) used exterior and interior FRP tubings. They had the same exterior FRP shell member, as $O8_{30}$-S, and were reinforced with the same bottom reinforcement 4ϕ15. The hole was provided by an interior circular FRP shell member shifted towards the tension zone, 45 mm below a central longitudinal axis of the exterior shell member. The length of the interior circular FRP shell members was 2.4 m, shorter than the length of exterior FRP shell members to keep the solid part at the support to prevent any local failure or web buckling at this region during the test. FIG. 20 shows the cross section and reinforcement shape of the three beam groups. Table 3 shows the details of beam specimens.

TABLE 3

Details of beam specimens

| Group | Beam ID | Outer tube | Inner tube | Bottom rft | Top rft | Stirrup | Concrete Strength |
|---|---|---|---|---|---|---|---|
| RC beam | RC | — | — | 4Φ15 | 2Φ10 | Φ10/ 150 mm | 36.7 MPa |
| Fully CFFT | $O8_{30}$-S | $O8_{30}$ | — | 4Φ15 | — | — | |
| Voided CFFT | $O8_{30}$-$I4_{30}$-S no.1 | $O8_{30}$ | $I4_{30}$ | 4Φ15 | — | — | |
| | $O8_{30}$-$I4_{30}$-S no.2 | $O8_{30}$ | $I4_{30}$ | 4Φ15 | — | — | |

Casting of Beams

The RC beams were cast horizontally in a wooden box formwork. Strong steel inclined formwork with an inclination angle of 25° was used to cast the concrete into shell members. The inclined formwork was used to simplify pouring concrete from the end gate and filling the shell members. Supporting the shell members against movement and blocking the end of the shell members was enough to begin the casting process. The shell members worked as permanent formwork. All beam specimens were cast with the same concrete batch. The concrete was a ready supplied patch. Its workability was enhanced by a super plasticizer additive. The average standard concrete compressive strength at 28 days was 36.7 MPa.

Test Setup and Instrumentations

Figure 21:
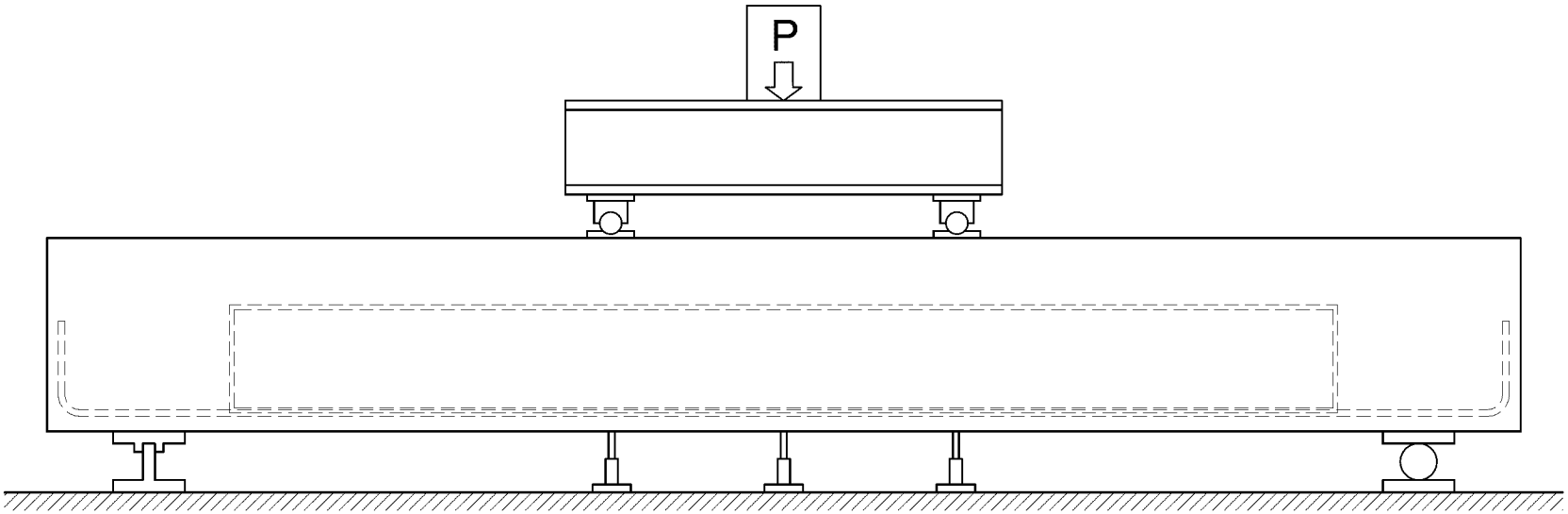
FIG. 21 is a schematic representation of a test set-up.

The beam specimens were tested using four-points bending as shown in FIG. 21. The beams were 3.20 m long. The clear span between supports of all beams was 2.75 m and the distance between the applied concentrated loads was 0.75 m. These lengths were chosen to ensure that beams tested are governed by flexure. The beams were loaded using displacement control with a 2000 kN capacity hydraulic actuator using displacement rate of 1 mm/min. Three displacement potentiometers (LVDTs) were used to measure the deflection profile along the beam length. Electrical strain gauges were attached to the reinforcing bars, concrete surface and FRP shell members at most critical section at mid-span. Longitudinal and lateral strains gauges were attached directly to the FRP shell member surface at the extreme tension and compression faces and at different levels along the depth of beam in addition to corners to draw the strain profile of the cross section and to see the confining action. The load, deflections, and strains were recorded during the test using a data acquisition system.

Results

Figure 22:
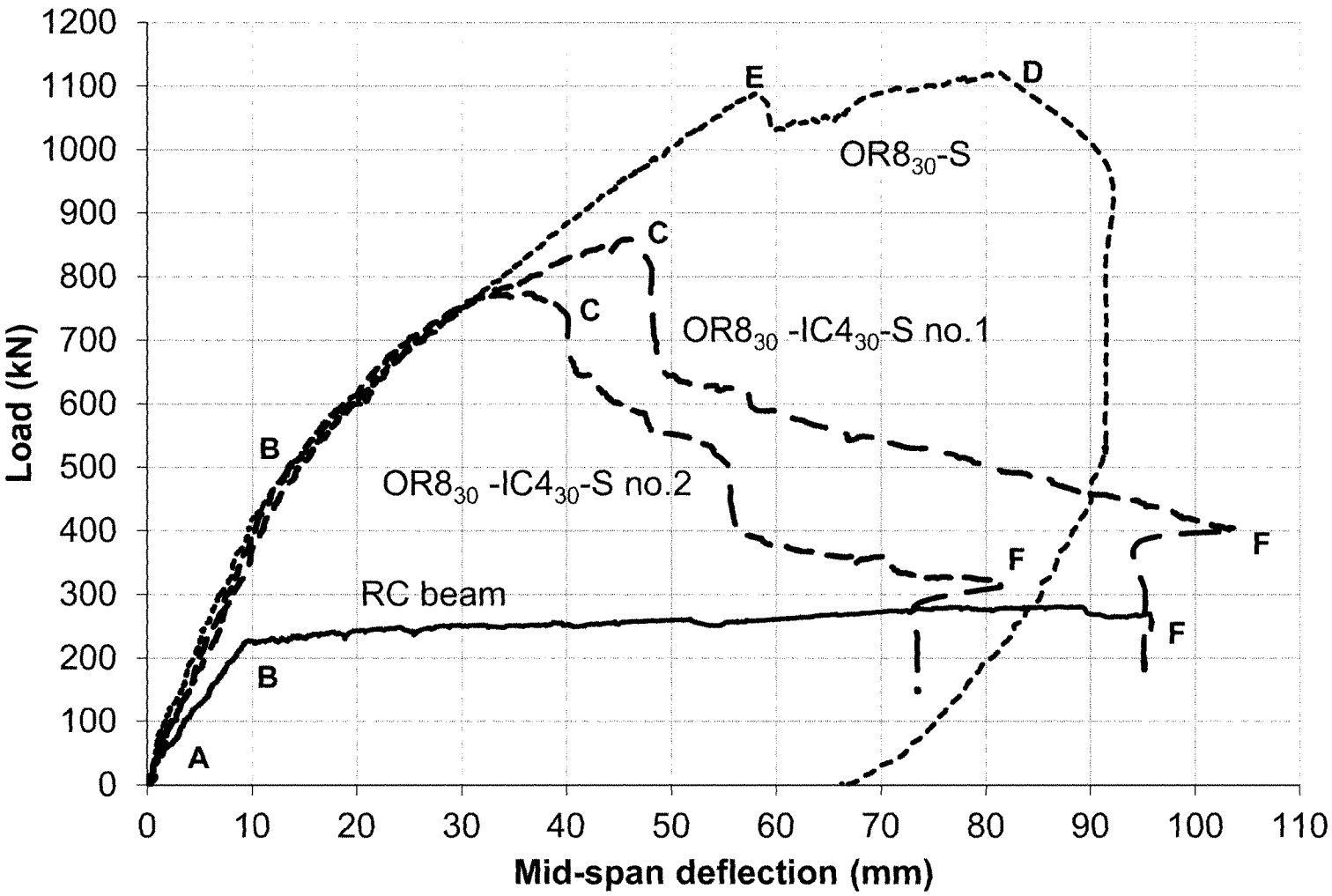
FIG. 22 is a graph showing a load-deflection response of four tested beams.
Figure 23:
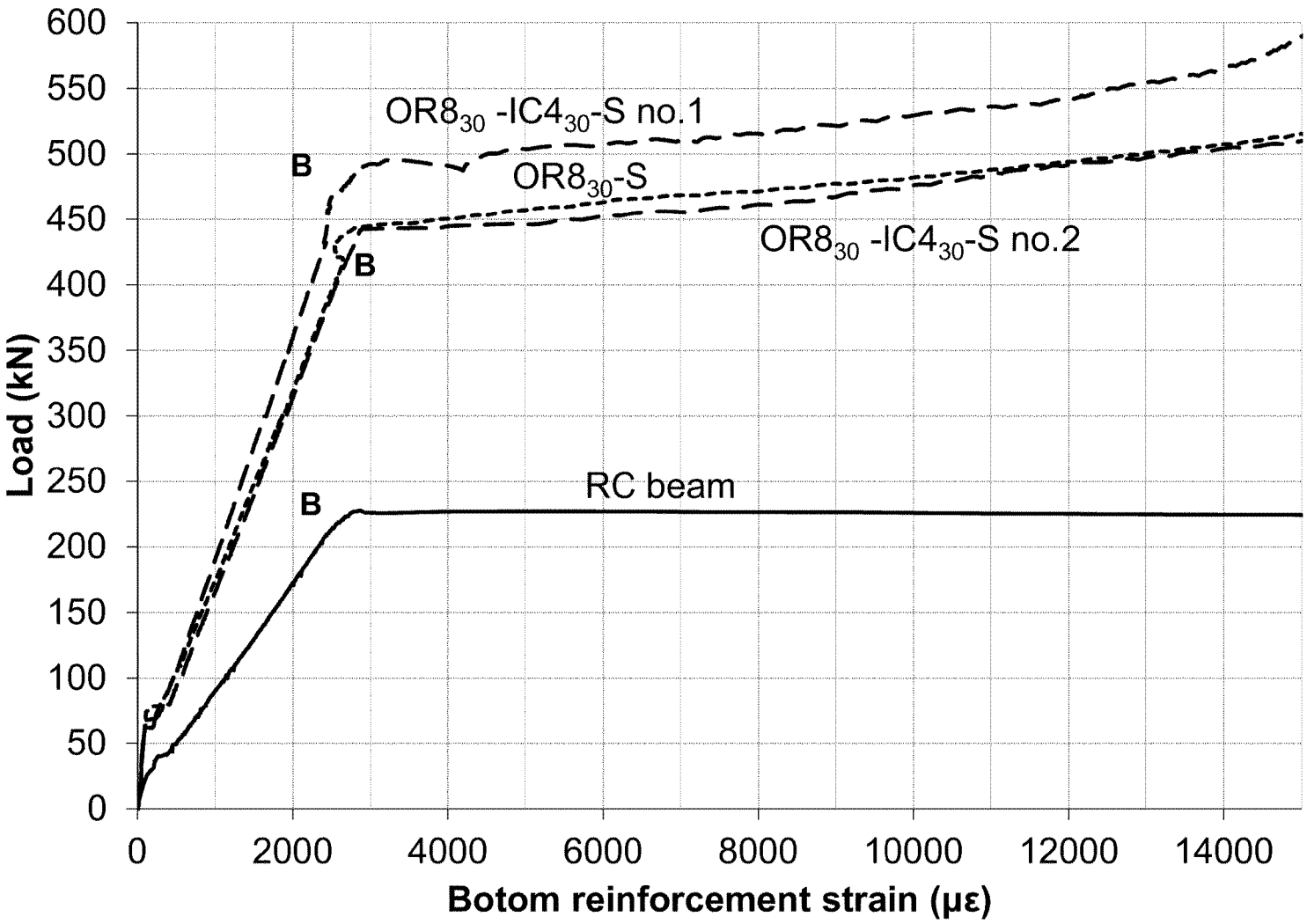
FIG. 23 is a graph showing a load-bottom steel reinforcement strain of the four tested beams.

The behavior of fully or partially CFFT with the conventional RC beam as a reference was compared in terms of strength and failure mode. Table 4 shows the summary of test results. FIG. 22 shows the load-deflection response of all beams. FIG. 23 shows the strain of bottom steel-reinforcement to know the values of loads at both first cracking of concrete and yielding of steel-reinforcement. FIG. 24 shows the pattern of failure of the beams. The curves show the gain in strength, stiffness, and ductility of the rectangular CFFT beams compared with a conventional RC beam.

TABLE 4

Summary of test results

| Group | Beam ID | Load (kN) Crack | Yield | Ultimate | Ultimate $P_i/P_{RC}$ | Ultimate Deflection (mm) | Failure mode |
|---|---|---|---|---|---|---|---|
| RC beam | RC | 41.1 | 229.1 | 280.4 | 1 | 96 | Tension |
| Fully CFFT | $O8_{30}$-S | 79.1 | 419.8 | 1118.1 | 3.99 | 81 | Tension |
| Voided CFFT | $O8_{30}$-$I4_{30}$-S no.1 | 69.6 | 469.2 | 858.9 | 3.06 | 46 | Comp. |
| | $O8_{30}$-$I4_{30}$-S no.2 | 53.8 | 441.1 | 773.8 | 2.76 | 37 | Comp. |

$P_i/P_{RC}$: Ultimate Load of a beam/Ultimate Load of RC Beam

Conventional RC Beam

Figure 24A:
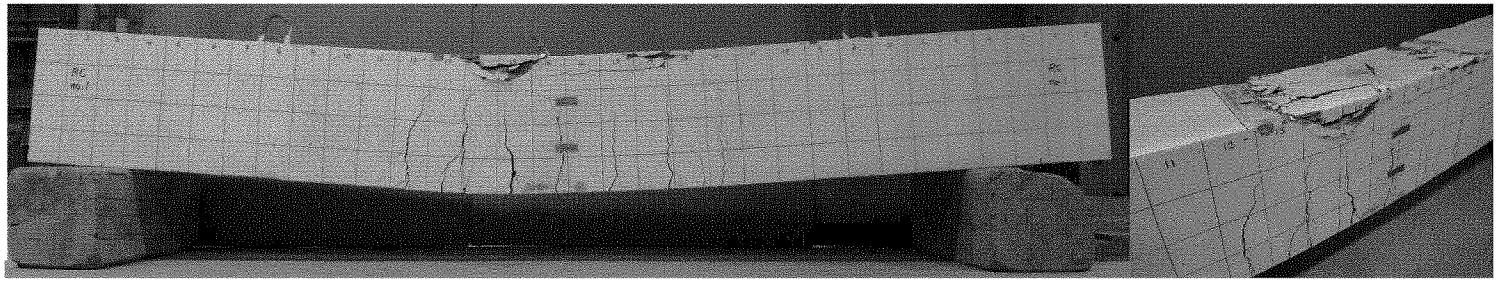
FIG. 24A is a photograph showing the failure pattern of the RC beam.

The conventional RC beam failed in tension under flexure. Vertical flexural cracks at the pure moment zone, and no diagonal cracks at shear zone were noted as shown in FIG. 24A. The first crack happened at point A. Then, the slope of the curve changed, due to changing from gross behavior to cracked behavior, with almost linear behavior till reaching the yielding point B. Afterwards, the yielding plateau was obtained until the failure point F where the concrete at compression reached its maximum strain.

Fully CFFT beam (O830-S)

Figure 24B:
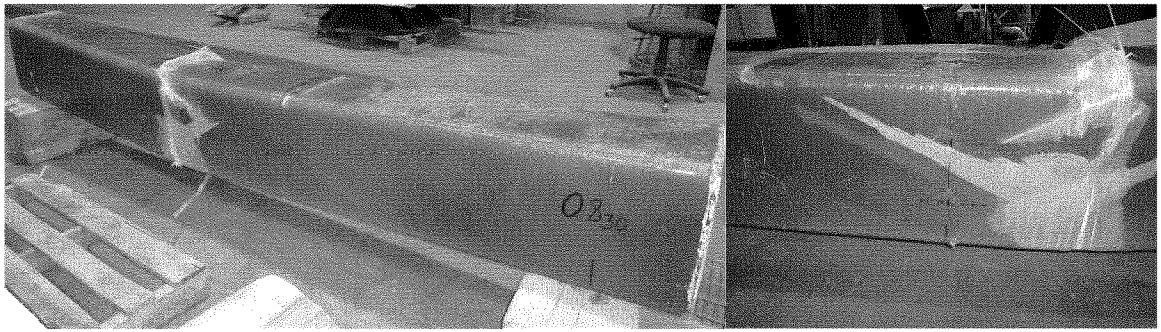
FIG. 24B is a photograph showing the failure pattern of the $O8_{30}$-S beam.

The fully CFFT beam ($O8_{30}$-S) was stiffer and stronger than the RC beam. The overall behavior is considered nonlinear, because of the nonlinearity of the concrete and the FRP shell members. The nonlinearity behavior in FRP shell members was obtained by the stacking sequence of the fibers in the composite. $O8_{30}$-S beam behavior started semi linear until reaching the yielding of the embedded reinforcement steel at point B. Then the slope was changed until reaching point E, where outward local buckling at the top flange and separation from the concrete occurred. This was the first warning sign of the failure. After point E, the shell member continued to carry an additional load depending on its whole section, especially the bottom flange, until it reached maximum failure load at point D. At this point, aggressive tension failure of the FRP shell member occurred suddenly by rupture of fibers at the tension side, as shown in FIG. 24B, with full loss of strength.

First cracks and yielding of steel were delayed compared with the RC beam. The increase of first crack load and yielding load was 100% and 78%, respectively compared with the RC beam. This was due to the confining action and the rough inner surface of the shell member which hampered crack propagations, in addition to the reinforcement ratio which was increased by the thickness of the shell member. Finally, the maximum capacity of $O8_{30}$-S beam was 300% more than the capacity of the conventional RC beam at failure. All previous notations mean very good performance for this type of rectangular CFFT.

Partially CFFT Beam (O830-I430-S)

Figure 24C:
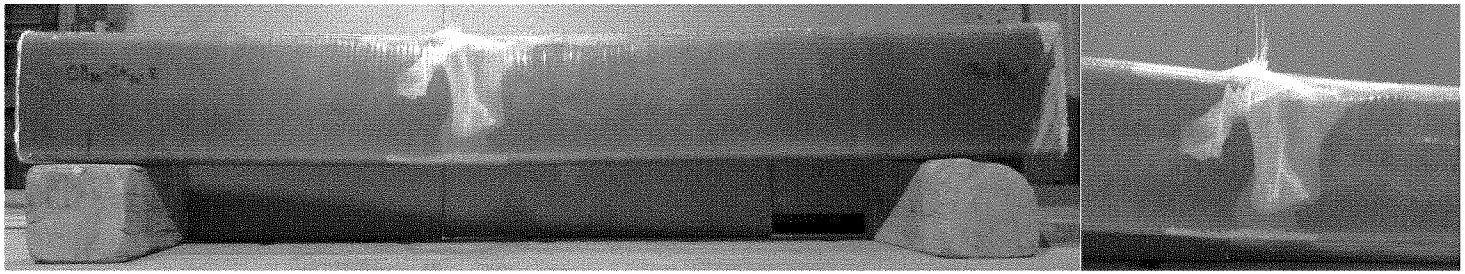
FIG. 24C is a photograph showing the failure pattern of the $O8_{30}$-$I4_{30}$-S; and It will be noted that throughout the appended drawings, like features are identified by like reference numerals.

Enhancement in the behavior of the partially CFFT beam ($O8_{30}$-$I4_{30}$-S) was also obtained in comparison with the conventional RC beam. $O8_{30}$-$I4_{30}$-S failed first at the top flange by rupture of the FRP shell member in a lateral direction of the shell member followed by buckling collapse of the interior shell member, which was noted by outward buckling of the exterior shell member sides, as shown in FIG. 24C and noted on the curve by point C, which indicates reaching maximum confinement action on the concrete. The failure pattern of the partially CFFT shell member was not aggressive like the fully CFFT one, some residual strength remained after failure as shown in FIG. 22.

The first cracking load and yielding load were increased by 40% and 97%, respectively compared with RC beam. The cracking load of the voided beam was 36% smaller than that of the fully CFFT beam ($O8_{30}$-$I4_{30}$-S) because of subtracting the hole area from gross section. On other hand, the yielding load was 10% more than the fully CFFT beam because of adding the area of interior shell member thickness to the reinforcement area at the tension zone in the cracked section. Both CFFT beams (fully and voided) could be considered to have identical flexural stiffness. Finally, the partially CFFT ($O8_{30}$-$I4_{30}$-S) capacity was 240% more than the capacity of the conventional RC beam and had better performance.

Although the flexural strength of the partially CFFT was 24% lower than that of the fully CFFT, the dead weight of it was 30% lighter than the fully one, resulting in an overall strength-to-weight ratio for $O8_{30}$-$I4_{30}$-S, 10% higher than $O8_{30}$-S. Since the failure began with rupture of fibers in a lateral direction and buckling collapse of the interior shell member, increasing the fiber percentage in the lateral direction of both the exterior and interior shell members and increasing the thickness of the interior shell member could enhance the strength of the partially CFFT. Also, providing an interior shell member having a substantially rectangular shape could prevent the buckling of the interior shell member and enhance the beam behavior.

The above-described composite structural member is relatively simple in construction and the shell members provide permanent formwork in addition to acting as reinforcement in the axial and lateral directions. In some implementations, the above-described composite structural member showed higher ductility, higher stiffness, and superior strength than the conventional RC beams. Furthermore, the rectangular fully CFFT beam failed aggressively in the tension side by rupture of fibers after buckling of the FRP compressive flange. The partially CFFT beam failed by rupture of FRP shell member in a lateral direction of the shell member at compressive flange followed by collapse of the interior shell member. The failure pattern of the partially CFFT beam was not aggressive like the failure pattern of the fully CFFT beam, but some residual strength remained after failure.

Moreover, although the embodiments of the composite structural member and corresponding parts thereof consist of certain geometrical configurations as explained and illustrated herein, not all of these components and geometries are essential and thus should not be taken in their restrictive sense. It is to be understood, as also apparent to a person skilled in the art, that other suitable components and cooperation therebetween, as well as other suitable geometrical configurations, may be used for the composite structural member, as will be briefly explained herein and as can be easily inferred herefrom by a person skilled in the art. Moreover, it will be appreciated that positional descriptions such as "above", "below", "left", "right" and the like should, unless otherwise indicated, be taken in the context of the figures and should not be considered limiting.

It will be appreciated that the methods described herein may be performed in the described order, or in any suitable order. Several alternative embodiments and examples have been described and illustrated herein. The embodiments of the invention described above are intended to be exemplary only. A person of ordinary skill in the art would appreciate the features of the individual embodiments, and the possible combinations and variations of the components. A person of ordinary skill in the art would further appreciate that any of the embodiments could be provided in any combination with the other embodiments disclosed herein. It is understood that the invention may be embodied in other specific forms without departing from the spirit or central characteristics thereof. The present examples and embodiments, therefore, are to be considered in all respects as illustrative and not restrictive, and the invention is not to be limited to the details given herein. Accordingly, while the specific embodiments have been illustrated and described, numerous modifications come to mind without significantly departing from the spirit of the invention. The scope of the invention is therefore intended to be limited solely by the scope of the appended claims.

The invention claimed is:

1. A structural member having a longitudinal axis comprising:

an exterior shell member having two opposed ends and defining an elongated channel with an inner surface;

an interior shell member having two opposed ends and having an outer surface and defining an inner channel, the interior shell member being inserted in the elongated channel of the exterior shell member and extending longitudinally therein; and concrete continuously filling space between the interior shell member and the exterior shell member and continuously covering the two opposed ends of the interior shell member with at least one reinforcement bar including a longitudinally extending section extending along the longitudinal axis and between the interior shell member and the exterior shell member and being disconnected from the inner surface of the exterior shell member and from the outer surface of the interior shell member, wherein at least one of the inner surface of the exterior shell member and the outer surface of the interior shell member comprises a polymeric coating including abrasive particles.

2. The structural member as claimed in claim 1, wherein each one of the two opposed ends of the interior shell member is spaced-apart inwardly along the longitudinal axis from a corresponding end of the exterior shell member and the inner channel is closed with concrete, the inner channel of the interior shell member comprising opposed end sections and the concrete covering the two opposed ends of the interior shell member extends continuously into the opposed end sections and a length of each one of the opposed end sections is between 5% and 20% of a length of the interior shell member.

3. The structural member as claimed in claim 1, wherein the interior shell member has a length along the longitudinal axis shorter than a length of the exterior shell member along the longitudinal axis, the interior shell member being contained in the exterior shell member and surrounded by the concrete, the structural member comprising at least one interior end spacing continuously filled with concrete, the at least one interior end spacing being defined between one of the opposed ends of the interior shell member spaced-apart inwardly along the longitudinal axis from a corresponding one of the opposed ends of the exterior shell member, and a length of the at least one interior end spacing is at least 10% of a length of the exterior shell member.

4. The structural member as claimed in claim 3, wherein the at least one reinforcement bar comprises a transversally extending section extending from the longitudinally extending section into a respective one of the at least one interior end spacing and a second longitudinally extending section extending from the transversally extending section between the exterior shell member and the interior shell member, the longitudinally and transversally extending sections being embedded in the concrete.

5. The structural member as claimed in claim 1, wherein the at least one reinforcement bar comprises a plurality of reinforcement bars connected together to define a reinforced concrete armature embedded in the concrete and spaced-apart from the outer surface of the interior shell member and the inner surface of the exterior shell member.

6. The structural member as claimed in claim 1, wherein the at least one reinforcement bar is spaced apart from the inner surface of the exterior shell member and comprises a hook at a free end thereof, and the outer surface of the interior shell member is embedded in concrete.

7. The structural member as claimed in claim 1, wherein the inner channel of the interior shell member is at least partially hollow, and wherein between 30% and 80% of a volume of the structural member is hollow.

8. The structural member as claimed in claim 1, wherein the structural member is an elongated beam and a central longitudinal axis of the interior shell member is decentered on a tension side of the elongated beam and the longitudinally extending section of the at least one reinforcement bar extends on a tension side of the elongated beam.

9. The structural member as claimed in claim 1, wherein at least one of the exterior shell member and the interior shell member comprises fiber reinforced polymer.

10. The structural member as claimed in claim 1, wherein a ratio of the diameters of the interior shell member and the exterior shell member is between 0.2 and 0.8 and a length of the interior shell member is between 30% and 80% the length of the exterior shell member.

11. A structural member having a longitudinal axis comprising:

an exterior shell member defining an elongated channel with an inner surface;

an interior shell member having an outer surface and defining an inner channel, inserted in the elongated channel of the exterior shell member and extending longitudinally therein and defining an inter-shell spacing therebetween; and concrete filling the inter-shell spacing and including at least one reinforcement bar having a longitudinally extending section extending in the inter-shell spacing and being disconnected from the inner surface of the exterior shell member and from the outer surface of the interior shell member, wherein the inner channel of the interior shell member comprises opposed end sections, the concrete filling continuously the opposed end sections and the inter-shell spacing and wherein each one of the opposed end sections has a length, and the length of each one of the opposed end sections is between 5% and 20% of the length of the interior shell member.

12. The structural member as claimed in claim 11, wherein each one of the interior shell member and the exterior shell member comprises two opposed ends, the ends of the inner shell member being spaced-apart inwardly along the longitudinal axis from a corresponding end of the exterior shell member and are covered with the concrete.

13. The structural member as claimed in claim 11, wherein the at least one reinforcement bar comprises a plurality of reinforcement bars connected together to define a reinforced concrete armature embedded in the concrete and spaced-apart from the outer surface of the interior shell member and the inner surface of the exterior shell member, at least one of the plurality of reinforcement bars comprises a transversally extending section extending from the longitudinally extending section into a respective one of the at least one interior end spacing.

14. The structural member as claimed in claim 11, wherein between 30% and 80% of a volume of the structural member is hollow.

15. The structural member as claimed in claim 11, wherein at least one of the exterior shell member and the interior shell member comprises fiber reinforced polymer, a ratio of the diameters of the interior shell member and the exterior shell member is between 0.2 and 0.8 and a length of the interior shell member is between 30% and 80% the length of the exterior shell member.

16. The structural member as claimed in claim 11, wherein at least one of the inner surface of the exterior shell member and the outer surface of the interior shell member comprises a plurality of grooves defined therein.

17. The structural member as claimed in claim 11, wherein at least one of the inner surface of the exterior shell member and the outer surface of the interior shell member comprises a plurality of spaced-apart pins protruding from a respective one of the inner surface of the exterior shell member and the outer surface of the interior shell member.

18. The structural member as claimed in claim 11, wherein at least one of the exterior shell member and the interior shell member comprises helicoidal fiber windings adjacent to a respective one of the inner surface and the outer surface.

19. A composite structural member assembly comprising:

at least two composite structural members as claimed in claim 1; and at least one connector assembly connecting together the at least two composite structural members mutually perpendicularly and including at least one structural member abutting plate and a plurality of anchors, the at least one structural member abutting plate being superposable to an outer surface of at least one of the at least two composite structural members, each one of the anchors having an inner section extending in at least a respective one of the at least two composite structural members and an outer end section extending beyond the outer surface of the respective one of the at least two composite structural members and engaged with a respective one of the at least one structural member abutting plate, the at least one structural member abutting plate and the plurality of anchors being configured to secure together the at least two composite structural members in a mutually perpendicular configuration.

20. The composite structural member assembly as claimed in claim 19, wherein a first one of the at least two composite structural members is a beam and a second one of the at least two composite structural members is a column and at least two of the anchors extends in an interior end spacing of the beam, the interior end spacing being defined between an end of the interior shell member spaced-apart inwardly along the longitudinal axis from a corresponding end of the exterior shell member.

21. The composite structural member assembly as claimed in claim 20, wherein at least two of the anchors extend in the column transversally to its longitudinal axis.

22. The composite structural member assembly as claimed in claim 19, wherein at least two of the anchors are "L"-shaped anchors embedded in the concrete.

23. The composite structural member assembly as claimed in claim 19, wherein the at least one structural member abutting plate comprises at least two structural member abutting plates, each one of the structural member abutting plates abutting an outer surface of a respective one of the composite structural members.

24. The composite structural member assembly as claimed in claim 23, wherein at least two of the anchors are straight anchors extending throughout the respective one of the composite structural members and having two opposed outer end sections, each one of the outer end sections being engaged with a respective one of the structural member abutting plates abutting opposite outer surfaces of the respective one of the composite structural members.

25. A process for manufacturing a structural member, comprising:

machining grooves on at least one of an inner surface of an exterior shell member, an outer surface of an interior shell member, and an inner surface of the interior shell member;

inserting the interior shell member having an inner channel and two opposed ends in an elongated channel of the exterior shell member;

inserting at least one reinforcement bar in an inter-shell spacing defined between the exterior shell member and the interior shell member; and filling inter-shell spacing with concrete with the at least one reinforcement bar being embedded in the concrete and the concrete continuously covering the two opposed ends of the interior shell member and filling partially the inner channel continuously from the two opposed ends wherein the grooves promote cohesion between the machined surface and the concrete.

26. The process as claimed in claim 16, further comprising inserting obstructing members in the inner channel of the interior shell member, the obstructing members being spaced apart from one another and spaced-apart inwardly from the opposed ends of the interior shell member, each one being positioned inside the inner channel at a distance of between 5% and 20% of a length of the interior shell member and from a respective one of the two opposed ends of the interior shell member.

* * * * *